US009211706B2

(12) United States Patent
Togashi

(10) Patent No.: US 9,211,706 B2
(45) Date of Patent: Dec. 15, 2015

(54) LIQUID EJECTING APPARATUS AND LIQUID EJECTING HEAD UNIT

(71) Applicant: SEIKO EPSON CORPORATION, Tokyo (JP)

(72) Inventor: Isamu Togashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/562,569

(22) Filed: Dec. 5, 2014

(65) Prior Publication Data

US 2015/0158303 A1 Jun. 11, 2015

(30) Foreign Application Priority Data

Dec. 9, 2013 (JP) ..... 2013-254484

(51) Int. Cl.
*B41J 2/165* (2006.01)
*B41J 2/14* (2006.01)

(52) U.S. Cl.
CPC *B41J 2/14* (2013.01); *B41J 2/1433* (2013.01); *B41J 2/16538* (2013.01); *B41J 2/16544* (2013.01); *B41J 2002/14443* (2013.01)

(58) Field of Classification Search
CPC ..... B41J 2002/14362
See application file for complete search history.

(56) References Cited

U.S. PATENT DOCUMENTS 6,729,717 B2 * 5/2004 Ito et al. ..... 347/84
7,484,828 B2 * 2/2009 Owaki ..... 347/44
7,490,923 B2 * 2/2009 Shibuya et al. ..... 347/47
2003/0076378 A1 4/2003 Nakamura et al.
2006/0098040 A1 * 5/2006 Kang ..... 347/33
2007/0257959 A1 * 11/2007 Miyazawa ..... 347/30
2011/0109691 A1 * 5/2011 Sato et al. ..... 347/33
2012/0249673 A1 * 10/2012 Mita ..... 347/33
2013/0215192 A1 * 8/2013 Eguchi et al. ..... 347/33
2015/0158301 A1 * 6/2015 Togashi ..... 347/29

FOREIGN PATENT DOCUMENTS

JP 2003-127405 5/2003
JP 2011-131484 7/2011

* cited by examiner

*Primary Examiner* — Stephen Meier
*Assistant Examiner* — John P Zimmermann
(74) *Attorney, Agent, or Firm* — Workman Nydegger

(57) ABSTRACT

There is provided a liquid-ejecting apparatus which ejects liquid from a liquid-ejecting head toward a recording medium in a first direction, including: the liquid-ejecting head which ejects the liquid from nozzle openings of a liquid-ejecting surface; a fixing board which is provided on the liquid-ejecting surface side of the liquid-ejecting head; and a wiper which relatively moves in a second direction. The plurality of fixing boards are disposed along the second direction. The fixing board includes: a bending portion in which an outer circumferential side part is bent to the liquid-ejecting head side; and an edge portion in which the outer circumferential side part is not bent. The plurality of edge portions are disposed on a side further outward than the nozzle openings in the first direction. The wiper wipes the liquid-ejecting surface side of the plurality of fixing boards in the second direction.

14 Claims, 14 Drawing Sheets

LIQUID EJECTING APPARATUS AND LIQUID EJECTING HEAD UNIT

CROSS REFERENCES TO RELATED APPLICATIONS

This application claims priority to Japanese Patent Application No. 2013-254484 filed on Dec. 9, 2013. The entire disclosure of Japanese Patent Application No. 2013-254484 is hereby incorporated herein by reference.

BACKGROUND

1. Technical Field

The invention relates to a liquid ejecting apparatus and a liquid ejecting head unit which are provided with a liquid ejecting head that ejects liquid from nozzle openings, and particularly relates to an ink jet type recording apparatus and an ink jet type recording head unit which are provided with an ink jet type recording head that ejects ink as the liquid.

2. Related Art

An ink jet type recording head which is an example of a liquid ejecting head includes a fixing board, such as a cover head, which is provided on a liquid ejecting surface side, a head main body which is stacked in a direction perpendicular to the liquid ejecting surface, and a maintaining portion which is adhered to a side opposite to the liquid ejecting surface of the head main body. In the liquid ejecting head, wiping for removing the liquid attached to the liquid ejecting surface or the like is performed, but since there is a possibility that an edge of an outer circumference of the fixing board at a time of wiping damages a wiper, the outer circumference of the fixing board is bent to a side opposite to the wiper and the edge is not in contact with the wiper (refer to JP-A-2011-131484).

However, when the plurality of fixing boards is disposed in zigzags and is a long line head, if all of the fixing boards are wiped at once, there is a problem in that the wiper is caught by the edge portion of the fixing board, the wiper is damaged by the edge portion, and a wiping effect deteriorates. Meanwhile, when the wiper is provided only by the number of the fixing boards and the wiping is performed for every fixing board, there is a problem in that the apparatus extends.

In addition, the problem exists not only in the ink jet type recording head, but also similarly in the liquid ejecting head unit which ejects liquid other than the ink.

SUMMARY

An advantage of some aspects of the invention is to provide a liquid ejecting apparatus and a liquid ejecting head unit, which do not have a concern that the wiper is damaged even when all of the fixing boards are wiped at once in a case where the plurality of fixing boards is disposed and is considered as a long line head.

Aspect 1

According to an aspect of the invention, there is provided a liquid ejecting apparatus which ejects liquid from a liquid ejecting head toward a recording medium in a first direction which is a feeding direction. The liquid ejecting apparatus includes: the liquid ejecting head which ejects the liquid from nozzle openings of a liquid ejecting surface provided with the group of nozzle openings; a fixing board which is provided on the liquid ejecting surface side of the liquid ejecting head; and a wiper which relatively moves in a second direction perpendicular to the first direction. The plurality of fixing boards are disposed along the second direction. The fixing board has: a bending portion in which an outer circumferential side part viewed from the liquid ejecting surface side is bent to the liquid ejecting head side; and an edge portion in which the outer circumferential side part is not bent. The plurality of edge portions of the plurality of fixing boards is disposed on a side further outward than the group of nozzle openings in the first direction. The wiper wipes the liquid ejecting surface side of the plurality of fixing boards by relatively moving in the second direction.

According to the aspect, since a part of the wiper which wipes the group of nozzle openings does not have interference by the edge portion of any of the fixing boards, a wiping defect does not occur, and durability of the wiper is excellent. In other words, even when the wiper which relatively moves in a direction that intersects with the group of nozzle openings is damaged by the edge portion, since the wiping of the group of nozzle openings is not performed at the location, the wiping effect with respect to the group of nozzle openings does not deteriorate. In addition, since the wiping can be performed by a common wiper with respect to the plurality of fixing boards, it is possible to prevent the apparatus from being extended. Furthermore, since the bending portion is formed by bending the fixing board, it is easy to achieve flatness of the fixing board and to perform a bending process of the fixing board since the edge portion remains at a corner.

Aspect 2

According to Aspect 1, it is preferable that a cap which performs capping by being abutted against the fixing board be provided, and the plurality of edge portions of the plurality of fixing boards be disposed on the side further outward than a capping area of the cap with respect to the fixing board in the first direction. According to this, even if the wiping is performed by the wiper which is damaged by the edge portion, the wiping of the capping area is not influenced and the wiping effect of the capping area does not decrease.

Aspect 3

In addition, according to Aspects 1 to 2, it is preferable that the bending portion be adhered to a side surface of a stacking member which is stacked on the liquid ejecting head side rather than on the fixing board. According to this, even when an adhesive which adheres the member that is stacked on the fixing board is a material which allows permeation of moisture included in the liquid, it is possible to suppress evaporation of the moisture by adhering the stacking member and the bending portion to each other.

Aspect 4

In addition, according to Aspects 1 to 3, it is preferable that the plurality of edge portions of the plurality of fixing boards be separated from the nozzle openings in the first direction by equal to or greater than a distance in consideration of meandering of the wiper. According to this, since the plurality of fixing boards is disposed in the second direction, the relative movement distance of the wiper increases and the wiper is likely to meander. However, by disposing the edge portion on the outer side equal to or greater than an amount of considered meandering, not only at an initiating position but also at an ending position of the relative movement of the wiper, it is possible to reduce a possibility that the wiping of the group of nozzle openings is performed by the part of the wiper which may be damaged by the edge portion.

Aspect 5

In addition, according to Aspects 1 to 4, it is preferable that the group of nozzle openings be provided along an inclination direction which is an inclined first direction, the wiper be disposed along the inclination direction, and the edge portion be disposed along the inclination direction. According to this, when the edge portion is in contact with the wiper, since both ends of the wiper are in contact with the edge portion at the same time, it is possible to reduce a possibility that the wiper is inclined compared to a case where only one side is in contact with the edge portion.

Aspect 6

In addition, according to Aspects 1 to 5, it is preferable that a plurality of openings be provided on each of the fixing boards and the group of nozzle openings be exposed from each of the openings. According to this, compared to a case where the fixing boards are provided for every group of nozzle openings, it is possible to make the number of edge portions small.

Aspect 7

In addition, according to Aspects 1 to 6, it is preferable that the liquid ejecting apparatus further include a maintaining member having leg portions at each of both sides of the first direction, and the fixing board be fixed to the maintaining member by the leg portions. According to this, it is possible to improve strength of the liquid ejecting head.

Aspect 8

In addition, according to Aspect 7, it is preferable that the fixing board have the bending portions at each of both sides of the second direction, and the fixing board be fixed to the side surface of the maintaining member by the bending portions. According to this, an area which is required to fix the fixing board may be ensured on the side surface of the maintaining member. Accordingly, it is possible to effectively suppress evaporation of moisture even when an interval of fixing boards disposed along the second direction is narrow.

Aspect 9

In addition, according to Aspect 8, it is preferable that the maintaining member have concave portions at each of the side surfaces of the first direction, and the fixing board be adhered to the concave portion of the side surface of the maintaining member by the bending portion. According to this, it is possible to easily adhere the fixing board and the maintaining member to each other. In addition, it is possible to further narrow the interval of the fixing boards disposed along the second direction.

Aspect 10

According to another aspect of the invention, there is provided a liquid ejecting head unit including: a plurality of liquid ejecting heads which eject liquid from nozzle openings of a liquid ejecting surface provided with the group of nozzle openings; and a plurality of fixing board which is provided on the liquid ejecting surface side of the liquid ejecting head. The plurality of fixing boards are disposed along a second direction in the liquid ejecting surface. The fixing board has: a bending portion in which a side part is bent to a side opposite to the liquid ejecting surface, at an outer circumference viewed from the liquid ejecting surface side; and an edge portion in which the outer circumferential side part is not bent. The plurality of edge portions of the plurality of fixing boards is disposed on a side further outward than the group of nozzle openings in a first direction perpendicular to the second direction on the liquid ejecting surface.

According to the aspect, even when the wiping is performed in a direction in which the plurality of liquid ejecting heads are provided in parallel, since a part of the wiper which wipes the group of nozzle openings does not have interference by the edge portion of any of the fixing boards, a wiping defect does not occur, and durability of the wiper is excellent. In other words, even when the wiper which relatively moves in a direction that intersects with the group of nozzle openings is damaged by the edge portion, since the wiping of the group of nozzle openings is not performed at the location, the wiping effect with respect to the group of nozzle openings does not deteriorate. In addition, since the wiping can be performed by a common wiper with respect to the plurality of fixing boards, it is possible to prevent the apparatus from being extended. Furthermore, since the bending portion is formed by bending the fixing board, it is easy to achieve flatness of the fixing board and to perform a bending process of the fixing board since the edge portion remains at a corner.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

Embodiment 1

Figure 1:
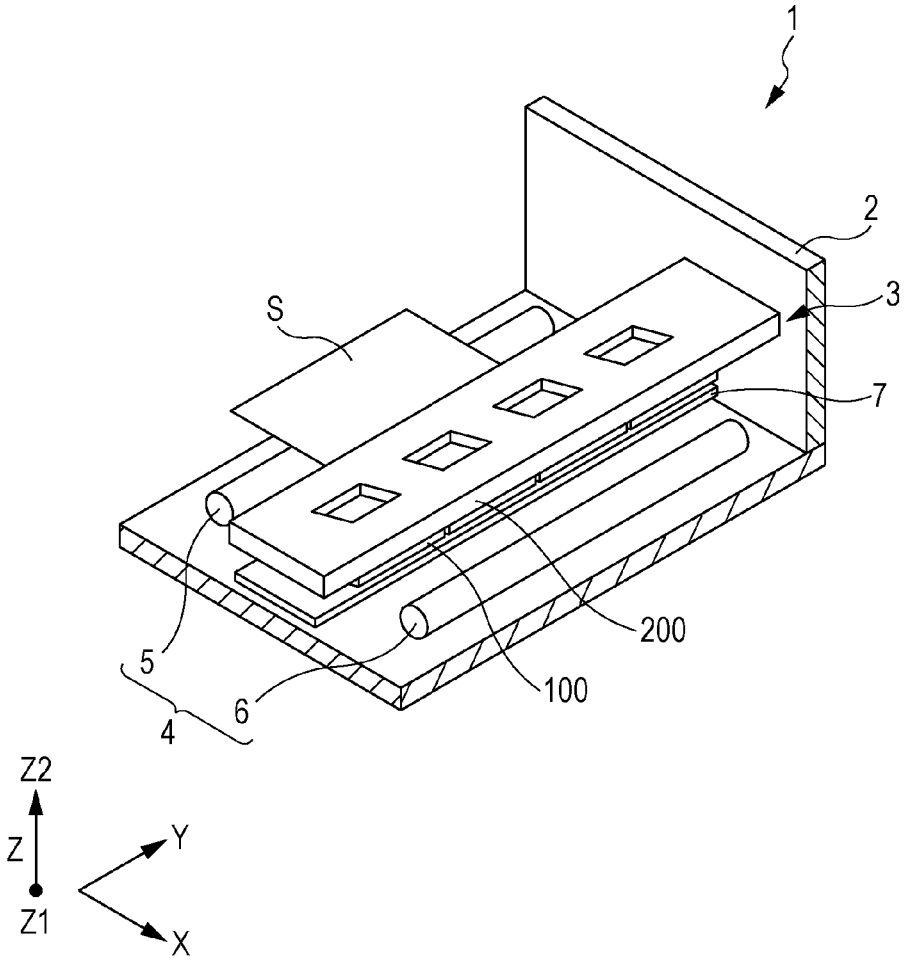
FIG. 1 is a schematic perspective view of a recording apparatus according to Embodiment 1 of the invention.

FIG. 1 is a schematic perspective view of a configuration of an ink jet type recording apparatus which is an example of a liquid ejecting apparatus according to Embodiment 1 of the invention.

The ink jet type recording apparatus which is an example of the liquid ejecting apparatus of the embodiment is a so-called line type recording apparatus in which an ink jet type recording head unit which is an example of a liquid ejecting head unit is fixed and printing is performed by transporting a recording sheet S, such as a paper sheet, which is an ejecting medium.

In particular, as illustrated in FIG. 1, an ink jet type recording apparatus 1 includes: an apparatus main body 2; an ink jet type recording head unit 3 (hereinafter, simply referred to as a head unit 3) which has a plurality of ink jet type recording heads 100 and is fixed to the apparatus main body 2; a transporting section 4 which transports a recording sheet S; and a supporting member 7 which supports the recording sheet S facing the head unit 3. In addition, in the embodiment, a transporting direction of the recording sheet S is called a first direction X. In addition, in in-plane directions in which nozzle openings of the head unit 3 are opened, a direction perpendicular to the first direction X is called a second direction Y. Furthermore, a direction perpendicular to the first direction X and the second direction Y is called a third direction Z. In addition, a liquid ejecting direction side (recording sheet S side) on the surface including the third direction Z is called a Z1 side, and an opposite side is called a Z2 side.

The head unit 3 includes a plurality of ink jet type recording heads 100 and a head fixing substrate 200 which maintains the plurality of ink jet type recording heads 100.

The plurality of ink jet type recording heads 100 is provided in parallel in a direction which intersects with the first direction X that is the transporting direction, in the embodiment, in the second direction Y perpendicular to the first direction X and is fixed to the head fixing substrate 200. In addition, in the embodiment, the plurality of ink jet type recording heads 100 is provided in parallel on a straight line of the second direction Y. In other words, the plurality of ink jet type recording heads 100 is not disposed to be shifted to the first direction X. Accordingly, it is possible to narrow a width of the head unit 3 in the first direction X, and to make the head unit 3 small.

In addition, the head fixing substrate 200 maintains the plurality of ink jet type recording heads so that nozzle openings 21 of the plurality of ink jet type recording heads face the recording sheet S side, and is fixed to the apparatus main body 2.

The transporting section 4 transports the recording sheet S in the first direction X with respect to the head unit 3. The transporting section 4 includes, for example, a first transporting roller 5 and a second transporting roller 6 which are provided at both sides in the first direction X that is the transporting direction of the recording sheet S with respect to the head unit 3.

By the first transporting roller 5 and the second transporting roller 6, the recording sheet S is transported. In addition, the transporting section 4 which transports the recording sheet S is not limited to a transporting roller, but may be a belt, a drum, or the like.

The supporting member 7 supports the recording sheet S transported by the transporting section 4 at a position facing the head unit 3. The supporting member 7, in which a cross section provided facing the head unit 3 between the first transporting roller 5 and the second transporting roller 6 is rectangular, is, for example, made of a metal or resin.

In addition, in the supporting member 7, an adsorbing section which adsorbs the transported recording sheet S onto the supporting member 7 is provided. Examples of the adsorbing section include a section which sucks and adsorbs by sucking the recording sheet S and a section which electrostatically adsorbs the recording sheet S by an electrostatic force. For example, when the transporting section 4 is a belt or a drum, the supporting member 7 supports the recording sheet S on the belt or the drum at the position facing the head unit 3.

In addition, a liquid storage section (not illustrated), such as an ink tank or an ink cartridge in which the ink is stored, is connected to each of the ink jet type recording heads 100 of the head unit 3 to be able to supply the ink. The liquid storage section, for example, may be maintained on the head unit 3, or may be maintained at a position different from the head unit 3 in the apparatus main body 2. In addition, a flow path for supplying the ink supplied from the liquid storage section to the ink jet type recording head 100, or the like, may be provided inside the head fixing substrate 200, and a flow path member may be provided in the head fixing substrate 200 and the ink from the liquid storage section may be supplied via the flow path member to the ink jet type recording head 100. Obviously, the ink may be supplied directly to the ink jet type recording head 100 without using the head fixing substrate 200 or the flow path member fixed to the head fixing substrate 200 from the liquid storage section.

In the ink jet type recording apparatus 1, the recording sheet S is transported by the first transporting roller 5, and the printing is performed on the recording sheet S supported on the supporting member 7 by the head unit 3. The printed recording sheet S is transported by the second transporting roller 6.

Figure 2:
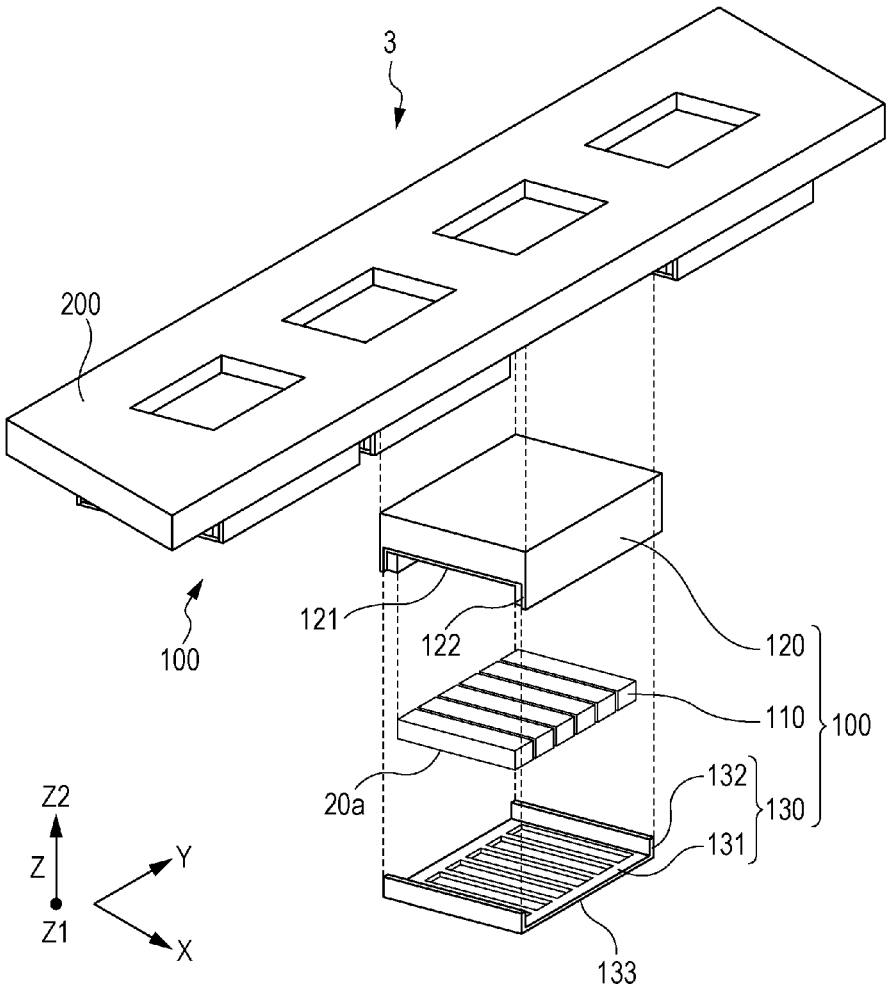
FIG. 2 is an exploded perspective view of a head unit according to Embodiment 1 of the invention.
Figure 3:
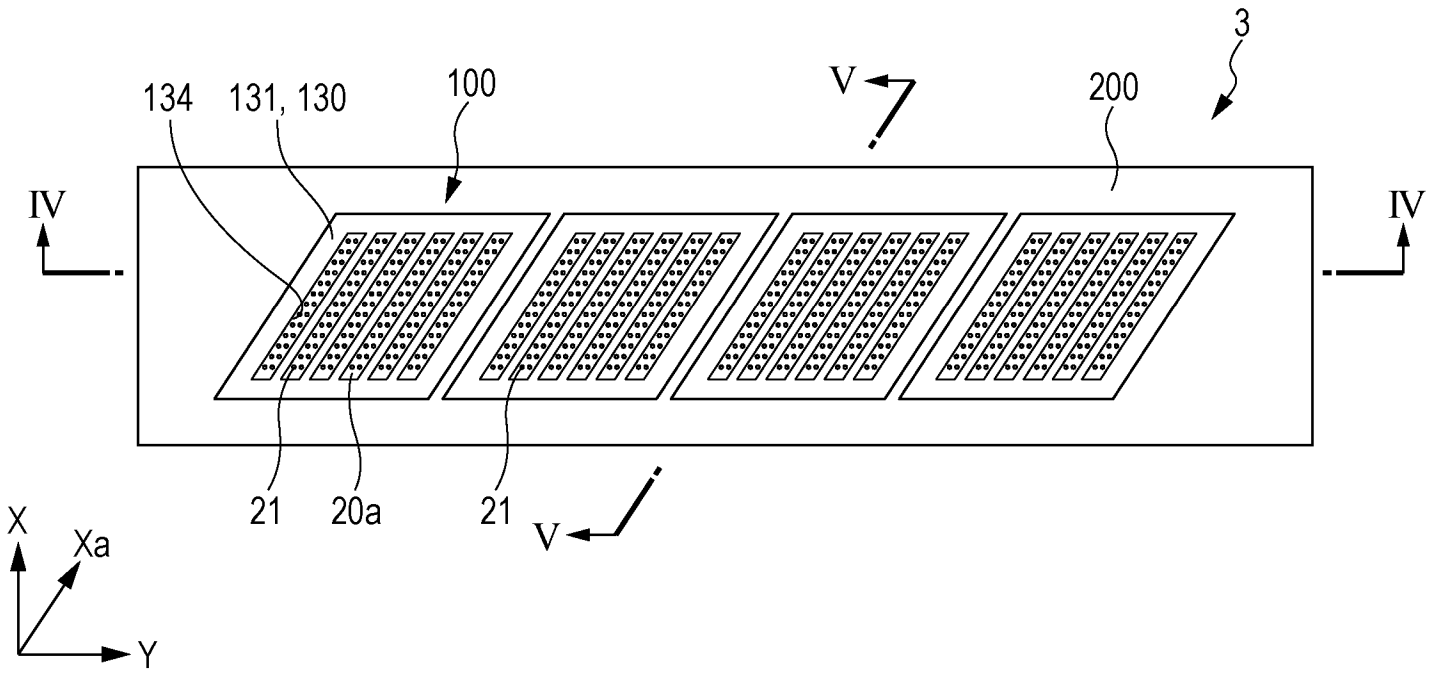
FIG. 3 is a plan view of the head unit according to Embodiment 1 of the invention.
Figure 4A:
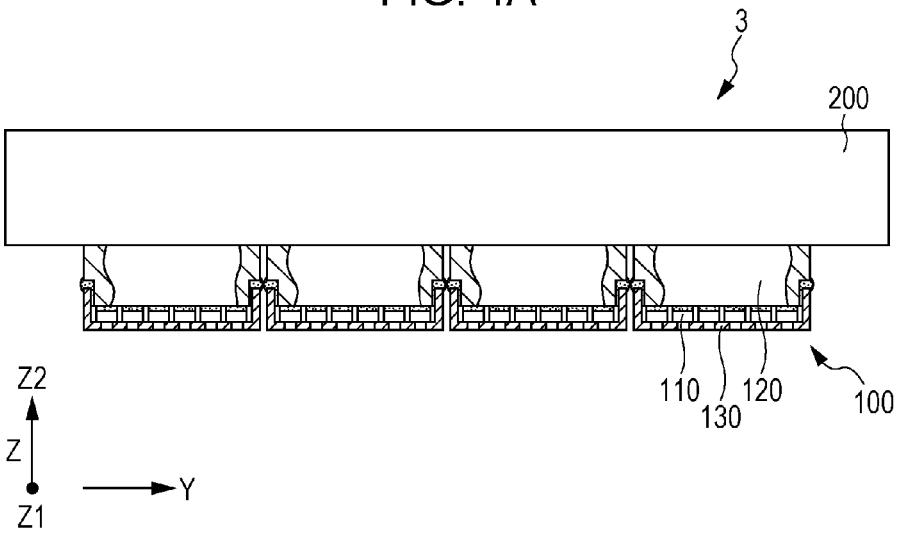
FIGS. 4A and 4B are a cross-sectional view and an enlarged view of the head unit according to Embodiment 1 of the invention.
Figure 4B:
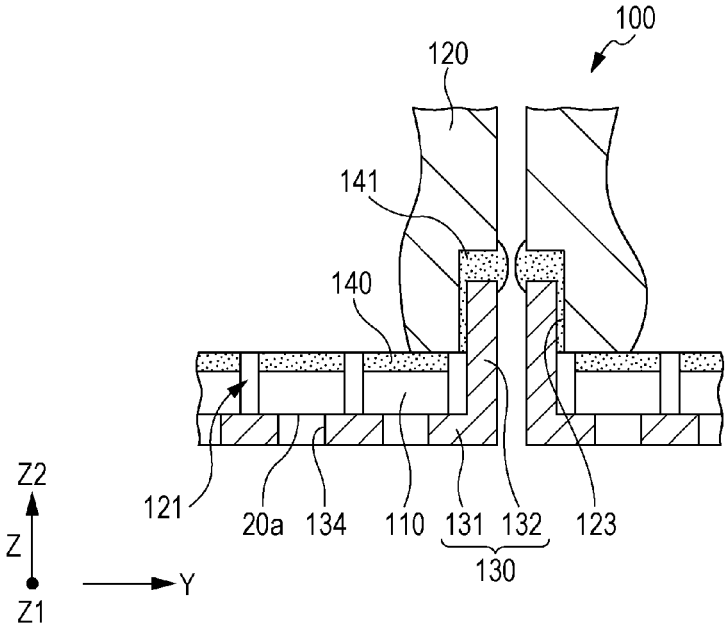
Figure 5:
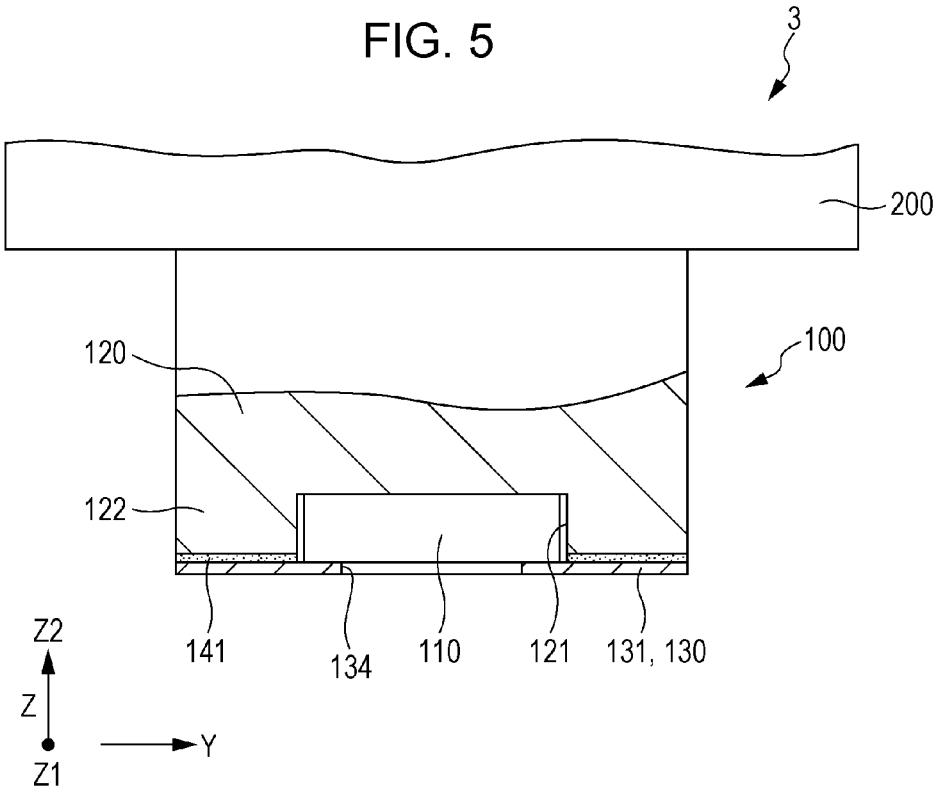
FIG. 5 is a cross-sectional view of the head unit according to Embodiment 1 of the invention.

Here, the head unit 3 which is mounted on the ink jet type recording apparatus 1 will be further described in detail with reference to FIGS. 2 to 5. In addition, FIG. 2 is an exploded perspective view illustrating the ink jet type recording head unit which is an example of the liquid ejecting head unit according to Embodiment 1 of the invention. FIG. 3 is a plan view of the liquid ejecting surface side of the ink jet type recording head unit. FIGS. 4A and 4B are a cross-sectional view which cuts out a main part along line IIIA-IIIA in FIG. 3 and an enlarged view of the main part, respectively. FIG. 5 is a cross-sectional view which cuts out the main part along line IIIB-IIIB in FIG. 3.

As illustrated in the drawings, the head unit 3 of the embodiment includes the plurality of ink jet type recording heads 100 and the head fixing substrate 200 which maintains the plurality of ink jet type recording heads 100.

The ink jet type recording head 100 has a liquid ejecting surface 20*a* provided with a nozzle opening 21 on the Z1 side of the third direction Z.

The ink jet type recording head 100 is fixed on the surface side facing the recording sheet S of the head fixing substrate 200, that is, the Z1 side which is the recording sheet S side of the third direction Z.

As described above, the plurality of ink jet type recording heads 100 is fixed to the head fixing substrate 200 provided in parallel on the straight line in the second direction Y perpendicular to the first direction X which is the transporting direction. In other words, the plurality of ink jet type recording heads 100 is not disposed to be shifted in the first direction X. Accordingly, it is possible to narrow the width of the head unit 3 in the first direction X, and to make the head unit 3 small. Obviously, the ink jet type recording heads 100 provided in parallel in the second direction Y may be disposed to be shifted in the first direction X, but when the ink jet type recording head 100 is largely shifted in the first direction X, the width of the head fixing substrate 200 or the like in the first direction X increases. In this manner, when the size of the head unit 3 in the first direction X becomes large, a distance between the first transporting roller 5 and the second transporting roller 6 in the first direction X in the ink jet type recording apparatus 1 increases, and it is difficult to fix the posture of the recording sheet S. In addition, the size of the head unit 3 and the ink jet type recording apparatus 1 becomes large.

In addition, in the embodiment, the four ink jet type recording heads 100 are fixed to the head fixing substrate 200. However, if the number of the ink jet type recording heads 100 is two or more, the number is not particularly limited.

Here, an example of the ink jet type recording head mounted on the head unit will be described in detail.

As illustrated in the drawings, the ink jet type recording head 100 includes: a plurality of head main bodies 110; a holder 120 which is a maintaining member of the embodiment that maintains the plurality of head main bodies 110; and a cover 130 which is a fixing board provided on the liquid ejecting surface 20*a* side of the head main body 110.

The head main body 110 has the liquid ejecting surface 20*a* provided with the nozzle opening 21 on the Z1 side of the third direction Z. In addition, a Z2 side of the plurality of head main bodies 110 is adhered to a surface of the Z1 side of the holder 120.

The holder 120 has a maintaining portion 121 which forms a space in a groove shape on the Z1 side. As the maintaining portion 121 is provided to be continued across the second direction Y on the surface of the Z1 side of the holder 120, the maintaining portion 121 is provided to be opened on both side surfaces of the second direction Y. In addition, in the holder 120, as the maintaining portion 121 is provided at a substantial center part of the first direction X, leg portions 122 are formed at both sides of the maintaining portion 121 in the first direction X. In other words, the leg portions 122 are provided only at both end portions in the first direction X on the surface of the Z1 side of the holder 120, and are not provided at both end portions in the second direction Y.

The plurality of head main bodies 110 is adhered to the inside of the maintaining portion 121 by an adhesive 140. In other words, the leg portions 122 are disposed at both sides in the third direction Z with respect to the head main body 110. In addition, a surface of the holder 120 and a surface of the head main body 110 which are facing each other in the third direction Z are adhered to each other by the adhesive 140. In addition, on the inside (not illustrated) of the holder 120, the flow path or the like which supplies the ink to the head main body 110 is provided, and a flow path of the holder 120 and a flow path of the head main body 110 communicate with each other to be sealed by the adhesive 140. In addition, the holder 120 may have a configuration in which a plurality of members is stacked in the third direction Z.

Here, the head main body 110, which will be described later in detail, has a configuration in which the plurality of members is stacked. In the plurality of head main bodies 110, irregularity in height in the third direction Z occurs according to dimensional tolerance of the plurality of members which constitutes each of the head main bodies 110 and irregularity in thickness of the adhesive or the like which stacks the plurality of members. In order to maintain the plurality of head main bodies 110 in which the irregularity in height in the third direction Z occurs by the common holder 120 and to arrange the liquid ejecting surface 20*a* of the plurality of head main bodies 110 on a plane surface, that is, in order to arrange the height of the liquid ejecting surface 20*a* in the third direction Z, it is required that the irregularity in height of the head main bodies 110 be absorbed by the adhesive 140 which adheres the holder 120 and the head main bodies 110 to each other. In this manner, it is preferable that an adhesive having relatively high viscosity be used as the adhesive 140 which absorbs the irregularity in height of the head main bodies 110. Even when the adhesive 140 is an adhesive having relatively high viscosity, there is a problem in that the moisture included in the ink evaporates from the adhesive 140 which adheres the holder 120 and the head main bodies 110 to each other. Even when only one head main body 110 is provided, there is a concern that the moisture included in the ink evaporates from the adhesive 140 which adheres the head main body 110 and the holder 120 to each other. In other words, even when the irregularity in height is not absorbed by the adhesive 140 which adheres the head main body 110 and the holder 120 to each other, there is a concern that the moisture evaporates from the adhesive 140 which adheres the head main body 110 and the holder 120 to each other.

Fixing the holder 120 and the head main body 110 with a screw or the like can also be considered. However, the size of the head main body 110 is small, and in the embodiment, since the plurality of the head main bodies 110 is required to be attached to one holder 120, it is difficult to fix the head main body 110 with a screw or the like via a seal member made of an elastic material. Therefore, by adhering the head main body 110 and the holder 120 to each other by the adhesive 140, it is possible to lower the cost by reducing the number of components and to seal the flow path which is connected to both of the head main body 110 and the holder 120 without providing the seal member or the like made of the elastic material therebetween.

In addition, the plurality of head main bodies 110 is adhered to the inside of the maintaining portion 121 of the holder 120 to be provided in parallel in the second direction Y. In the embodiment, six head main bodies 110 are adhered to one holder 120. The number of the head main bodies 110 fixed to one holder 120 is not limited to the above-described number. The number of the head main bodies 110 with respect to one holder 120 may be one, or may be two or more. By providing the plurality of head main bodies 110 with respect to one ink jet type recording head 100 and making plural nozzle rows, it is possible to improve yield, compared to a case where the plural nozzle rows are provided only to one head main body 110 with respect to one ink jet type recording head 100. In other words, by making the plural nozzle rows in one head main body 110, the yield of the head main body 110 decreases and the manufacturing cost increases. In contrast to this, by fixing the plurality of head main bodies 110 to the common holder 120 and making the plural nozzle rows by the plurality of head main bodies 110, it is possible to improve the yield of the head main body 110 and to reduce the manufacturing cost.

In addition, the plurality of head main bodies 110 of the embodiment is fixed so that the nozzle rows are inclined with respect to the first direction X which is the transporting direction of the recording sheet S, in the in-plane directions of the liquid ejecting surface 20*a*. In other words, with respect to the first direction X, a fourth direction Xa, which is a parallel direction of the nozzle openings 21 that constitute the nozzle row, is inclined. In the embodiment, in the ink jet type recording head 100, the plurality of head main bodies 110 is provided in parallel in the second direction Y, and the ink jet type recording head 100 can be disposed at a position where at least parts of the nozzle openings 21 of the adjacent head main bodies 110 in the second direction Y are overlapped with each other in the first direction X. In addition, the plurality of ink jet type recording heads 100 is provided in parallel in the second direction Y, and can be disposed at a position where at least parts of the nozzle openings 21 of the adjacent head main bodies 110 in the second direction Y are overlapped with each other in the first direction X. Accordingly, it is possible to form the nozzle openings 21 which are provided in parallel at a similar interval in the second direction Y of the head unit 3.

The cover 130 corresponds to the fixing board of the embodiment, and is made of a board-shaped member, such as a metal. The cover 130 is provided on the liquid ejecting surface 20*a* side of the ink jet type recording head 100, that is, on the Z1 side of the third direction Z of the ink jet type recording head 100.

The cover 130 is formed by bending a member which is in a flat board shape, and includes a base portion 131 provided on the liquid ejecting surface 20*a* side and a bending portion 132 in which both end portions of the base portion 131 in the second direction Y are provided to be curved to the Z2 side of the third direction Z. In the embodiment, since the bending portion is not provided in the vicinity of both ends of the first direction X, it is possible to consider the entire vicinity of both ends of the second direction Y of the base portion 131 as the bending portion 132, and an edge portion does not exist. Meanwhile, the entire vicinity of both ends of the first direction X is an edge portion 133.

As illustrated in FIG. 5, the base portion 131 is bonded to the surface of the Z1 side of the holder 120 in the third direction Z, that is, to an end surface of the Z1 side of the leg portions 122 via an adhesive 141.

In addition, as illustrated in FIGS. 4A and 4B, an exposure opening portion 134 which is an opening for exposing the nozzle openings 21 of each of the head main bodies 110 is provided in the base portion 131. In the embodiment, the exposure opening portion 134 is provided to be independently opened for every head main body 110. In other words, since the ink jet type recording head 100 of the embodiment has six head main bodies 110, six independent exposure opening portions 134 are provided in the base portion 131. According to the configuration of the head main body 110 or the like, one common exposure opening portion 134 may be provided with respect to a head main body group which is configured to have the plurality of head main bodies 110.

In addition, in the embodiment, since the leg portions 122 are not provided in the maintaining portion 121 in the second direction Y, the exposure opening portion 134 is provided to the vicinity of the bending portion 132 in the second direction Y. In other words, the interval from the entire circumference of the base portion 131 to the exposure opening portion 134 becomes smaller in the second direction Y than in the first direction X.

The Z1 side of the maintaining portion 121 of the holder 120 is covered by the base portion 131.

In addition, the bending portion 132 is provided at both end portions of the base portion 131 in the second direction Y, and is formed at a size that can cover the area of the opening which is opened to the side surface of the maintaining portion 121 in the second direction Y. In other words, the bending portion 132 is an area from the end portion of the base portion 131 in the second direction Y to an edge portion of the cover 130. The bending portion 132 is bonded to the side surface of the holder 120 in the second direction Y via the adhesive 141. Accordingly, the opening to the side surface of the maintaining portion 121 in the second direction Y is sealed to be covered by the bending portion 132.

In other words, between the holder 120 and the cover 130, the end surface of the leg portions 122 in the third direction Z and the base portion 131 are adhered to each other by the adhesive 141 at both sides of the first direction X, and the opened side surface of the maintaining portion 121 and the bending portion 132 are adhered to each other at both sides of the second direction Y via the adhesive 141. Accordingly, the head main body 110 is disposed in the maintaining portion 121 which is the space between the holder 120 and the cover 130. In other words, the adhesive 140 which adheres the head main body 110 and the holder 120 to each other is included in the maintaining portion 121 which is the space formed by adhering the holder 120 and the cover 130 by the adhesive 141. Therefore, even when the adhesive 140 is likely to allow permeation of the moisture included in the ink as the adhesive 140 which adheres the holder 120 and the head main body 110 to each other, since the inside of the maintaining portion 121 is sealed by the adhesive 141 which adheres the holder 120 and the cover 130, it is possible to suppress the evaporation of the moisture included in the ink. In addition, in order to seal the inside of the maintaining portion 121, it is preferable to adhere the base portion 131 of the cover 130 and the liquid ejecting surface 20*a* side of the head main body 110 to each other. In other words, it is appropriate that the vicinity of the exposure opening portion 134 is adhered to the head main body 110 so that the moisture does not evaporate to the outside via the exposure opening portion 134. In addition, it is appropriate that the adhesive 141, which adheres the holder 120 and the cover 130 to each other, adheres the holder 120 and the head main body 110, and is unlikely to allow permeation of the moisture as opposed to the adhesive 140 which absorbs the irregularity in height of the head main body 110.

In this manner, in the embodiment, at both sides of the holder 120 in the second direction Y, by providing the bending portion 132 in the cover 130, the cover 130 and the holder 120 are adhered to each other. Accordingly, at both sides of the holder 120 in the second direction Y, the leg portions to be adhered to the base portion 131 of the cover 130 are not required. For this reason, when the ink jet type recording head 100 is provided in parallel in the second direction Y, the leg portions do not exist at a side between the adjacent ink jet type recording heads 100. Therefore, it is possible to narrow the interval between the adjacent ink jet type recording heads 100 in the second direction Y. Accordingly, it is possible to provide the head main bodies 110 of the adjacent ink jet type recording heads 100 to be close to each other in the second direction Y, and to provide the nozzle openings 21 provided in each of the head main bodies 110 of the adjacent ink jet type recording heads to be close to each other in the second direction Y.

In order to suppress evaporation of the moisture included in the ink without providing the bending portion 132 which is adhered to the holder 120 at both sides of the cover 130 in the second direction Y, it is required that the leg portions be provided at both sides of the holder 120 in the second direction Y, and that the end surface of the Z1 side of the leg portions and the base portion 131 are adhered to each other. In other words, it is required that the maintaining portion 121 be provided to be opened only to the Z1 side of the third direction Z. In this manner, when the leg portions are provided at both sides of the second direction Y, the interval between the maintaining portions 121 of the adjacent ink jet type recording heads 100 widens, and it is not possible to provide the head main bodies 110 of the adjacent ink jet type recording heads 100 to be close to each other, and thus, the nozzle openings 21 are disposed to be separated in the second direction Y. In other words, in order to provide the ink jet type recording heads 100 which are adjacent to each other and to provide the head main bodies 110 of the ink jet type recording heads 100 to be close to each other, the leg portions 122 may not be provided at both sides of the second direction Y which is the direction in which the ink jet type recording heads 100 are provided in parallel. Here, the maintaining portion 121 is provided with the opening, which communicates with the space where the head main bodies 110 are disposed, at both side surfaces of the second direction Y. In addition, in the configuration, when the cover 130 adheres only to the end surface of the Z1 side of the leg portions 122 of the holder 120, the inside of the maintaining portion 121 is opened to the outside on both side surfaces of the second direction Y, and the moisture which permeates the adhesive 140 that adheres the holder 120 and the head main bodies 110 to each other evaporates to the outside.

In the embodiment, by sealing the maintaining portion 121 which is opened to both side surfaces of the second direction Y for providing the head main bodies 110 to be close to each other by the bending portion 132 of the cover 130, without providing the leg portions at both sides of the second direction Y, it is possible to narrow the interval of the adjacent ink jet type recording heads 100 in the second direction Y, to provide the nozzle openings 21 of the adjacent ink jet type recording heads 100 to be close to each other, and to suppress evaporation of the moisture which permeates the adhesive 140 that adheres the head main bodies 110 and the holder 120 to each other.

In addition, in the embodiment, a concave portion 123 is provided on the side surface of the holder 120 in the second direction Y, and the bending portion 132 is adhered to the inside of the concave portion 123. The concave portion 123 is provided to be opened to both side surfaces of the second direction Y and to be opened to the surface of the Z1 side in the third direction Z. As the concave portion 123 is provided in the holder 120, the bending portion 132 is inserted and adhered to the inside of the concave portion 123. For this reason, it is possible to easily adhere the holder 120 and the bending portion 132 of the cover 130 to each other. In other words, by providing the concave portion 123 in the holder 120, a space between the holder 120 and the bending portion 132 of the cover 130 is filled with the adhesive 141 by a capillary force only by coating the adhesive 141 between the end portion of the bending portion 132 of the cover 130 which is inserted into the concave portion 123 and the concave portion 123. For this reason, it is not required that a process be performed in which the adhesive 141 is coated from a direction which faces a different direction along the end portion of the bending portion 132 with respect to a gap between the holder 120 and the bending portion 132 without the concave portion 123, and thus it is possible to simplify the adhesion process. In addition, in the embodiment, by providing the concave portion 123 in the holder 120, a protrusion amount of the bending portion 132 of the cover 130 in the second direction Y can be small, the interval of the adjacent ink jet type recording heads 100 in the second direction Y can further narrow, and the interval of the nozzle openings 21 of the adjacent ink jet type recording heads 100 can further narrow. In addition, by providing the concave portion 123 in the holder 120 and inserting the bending portion 132 into the concave portion 123, even when the irregularity in bending angle of the bending portion 132 occurs, it is possible to make the protrusion amount of the bending portion 132 in the second direction Y small. For this reason, it is possible to suppress interference of the bending portion 132 in the adjacent ink jet type recording heads 100. Accordingly, it is possible to narrow the interval between the ink jet type recording heads 100 adjacent to each other.

In this manner, in the head unit 3 of the embodiment, when the plurality of ink jet type recording heads 100 which suppresses evaporation of the moisture of the ink is provided in parallel in the head fixing substrate 200 in the second direction Y, it is possible to narrow the interval between the ink jet type recording heads 100 adjacent to each other in the second direction Y. For this reason, it is possible to narrow the interval of the nozzle openings 21 of the adjacent ink jet type recording heads 100. In addition, since the interval of the nozzle openings 21 of the adjacent ink jet type recording heads 100 can narrow, it is possible to provide the plurality of ink jet type recording heads 100 in parallel on the straight line which extends in the second direction Y, and to make the width of the head unit 3 in the first direction X small.

In the embodiment, since the width of the head unit 3 in the first direction X can be small, it is possible to shorten the distance between the first transporting roller 5 and the second transporting roller 6 in the first direction X, to make it easy to fix the posture of the recording sheet S, and to improve the printing quality. In addition, it is possible to make the head unit 3 and the ink jet type recording apparatus 1 small.

As illustrated in FIG. 3, when viewed from the liquid ejecting surface **20*a* side in a planar view, the ink jet type recording head 100 of the embodiment has a shape which is a substantial parallelogram. As described above, this is because the fourth direction Xa, which is a direction in which the nozzle openings 21 that constitute the nozzle rows of each of the head main bodies 110 are provided in parallel, is provided to be inclined with respect to the first direction X which is the transporting direction of the recording sheet S, and an external shape of the ink jet type recording head 100 is formed to be a substantial parallelogram in the fourth direction Xa which is the direction in which the nozzle rows are inclined. The shape when viewed from the liquid ejecting surface 20*a* side of the ink jet type recording head 100** in a planar view is not limited to the substantial parallelogram, and the shape may be rectangular, trapezoidal, or polygonal.

By disposing the plurality of ink jet type recording heads 100 and setting as the ink jet type recording head unit, effects, such as improved yield in manufacturing, easy processing, or easy flattening of the plane surface of the cover 130 which is the fixing board, can be achieved.

In addition, in the embodiment, the leg portions 122 are provided at both sides of the holder 120 in the first direction X, but the leg portions 122 may not be provided. In other words, the head main body 110 may be adhered to the surface of the Z1 side of the holder 120, and the bending portion 132 may be provided at both sides of the cover 130 in the first direction X and the second direction Y. In other words, in the cover 130, the bending portion 132 may be provided across the entire circumference in the in-plane directions of the liquid ejecting surface **20*a*, and the cover 130 may be adhered across the entire circumference of the side surface of the holder 120. Accordingly, it is possible to make the width of the head unit 3 in the first direction X much smaller. In addition, by making the width of the head unit 3 in the first direction X small, it is possible to provide the plurality of head units 3 to be close to each other in the first direction X. However, it is required that the cover 130 which has the bending portion 132 across the entire circumference of the base portion 131 be formed by a drawing process. However, in the drawing process, there is a case where the length of the bending portion 132 is not sufficiently ensured and manufacturing is difficult. In addition, as illustrated in the embodiment, by adhering the end surface of the Z1 side of the leg portions 122 to the base portion 131 of the cover 130, it is possible to improve strength of the ink jet type recording heads 100 in the third direction Z. In addition, by adhering the end surface of the Z1 side of the leg portions 122 to the base portion 131 of the cover 130, it is possible to support the pressure at a time of adhering the cover 130 and the holder 120 to each other by the leg portions 122, and to suppress a destruction of the head main body 110 or the like by suppressing the pressure directly applied to the head main body 110**.

In addition, in the embodiment, the leg portions 122 are not provided at both sides of the holder 120 in the second direction Y. However, by providing the leg portions 122 at both sides of the second direction Y, it is possible to improve strength of the ink jet type recording head 100 in the third direction Z. In this case, the length of the end surface of the Z1 side in the second direction Y of the leg portions 122 provided at both sides of the second direction Y is made to be shorter than the length of the end surface of the Z1 side in the first direction X of the leg portions 122 provided at both sides of the first direction X. Accordingly, it is possible to narrow the interval of the ink jet type recording heads 100 adjacent to each other in the second direction Y. In addition, in this case, at both sides of the second direction Y, by adhering the bending portion 132 and the side surface of the holder 120 to each other by the adhesive 141, it is possible to ensure an area which is required to adhere the cover 130 to the side surface of the holder 120, and to effectively suppress evaporation of the moisture.

In addition, in the embodiment, neither end portion of the base portion 131 in the first direction X is curved toward the Z2 side, and the leg portions 122 are adhered to the base portion 131 on the liquid ejecting surface 20*a* side. The embodiment is not limited thereto, and for example, the bending portion may also be formed by leaving end portions of both ends of the second direction Y of both end portions of the base portion 131 in the first direction X as the edge portion.

Accordingly, as a corner of the ink jet type recording head 100 in the first direction X on the liquid ejecting surface 20*a* side is covered by the cover 130, it is possible to suppress a defect, such as peeling of the cover 130, due to the abutting recording sheet S.

Figure 6:
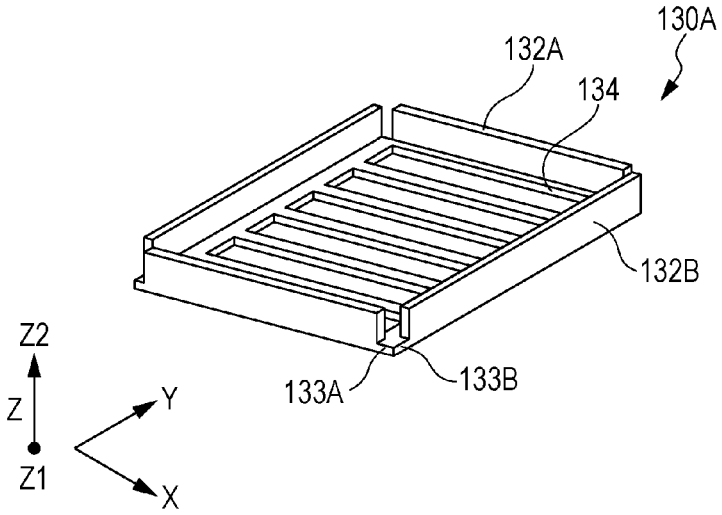
FIG. 6 is a perspective view illustrating a cover according to a second example of Embodiment 1 of the invention.

An example of the cover is illustrated in FIG. 6. A cover 130A includes a bending portion 132A and an edge portion 133A at the side parts of both ends of the base portion 131 in the first direction X, and includes a bending portion 132B and an edge portion 133B at the side parts of both ends in the second direction Y. Here, edge portions 133A exist at both end portions of the second direction Y of the side parts of both ends of the first direction X. The edge portions 133B exist at both end portions of the first direction X of the side parts of both ends of the second direction Y. In other words, the edge portions 133A and 133B exist at corners of the cover 130A. When the bending portion is provided to cover the corners, a process, such as a drawing process, is required, and the manufacturing process is difficult. In particular, at a corner of an acute angle side in a case of the above-described parallelogram, the drawing process is difficult. In addition, when the drawing process is performed, there is a concern that flatness of the cover deteriorates.

In this manner, in the four side parts of the outer circumference of the cover, by providing the bending portion in a state where the edge portion remains at both ends of the side parts, since the flatness of the cover is easily achieved and the bending portion may be formed by leaving the edge portion, the effect that the bending process is easy is achieved.

In addition, by forming the bending portion, in addition to the above-described effect, there is an effect that a grounding function or a covering function with respect to a collision of the member and the paper sheet in the stacking direction is achieved.

In the above-described embodiment, in the first direction X, the edge portions 133, 133A, and 133B of the covers 130 and 130A are disposed on the side further outward than the nozzle opening area provided with the nozzle openings 21. According to this configuration, at a time of wiping by the wiper, since the part of the wiper which performs the wiping of the nozzle openings does not have interference by the edge portions 133, 133A, and 133B of the covers 130 and 130A, an effect that the wiping defect does not occur and durability of the wiper is excellent is achieved. In other words, even when the wiper which relatively moves in the direction that intersects with the nozzle openings 21 is damaged by the edge portions 133, 133A, and 133B, since the wiping of the group of nozzle openings 21 is not performed at the location, the wiping effect with respect to the group of nozzle openings 21 does not deteriorate. In addition, since the wiping can be performed by a common wiper with respect to the plurality of covers 130 and 130A, it is possible to prevent the apparatus from being extended.

Figure 7:
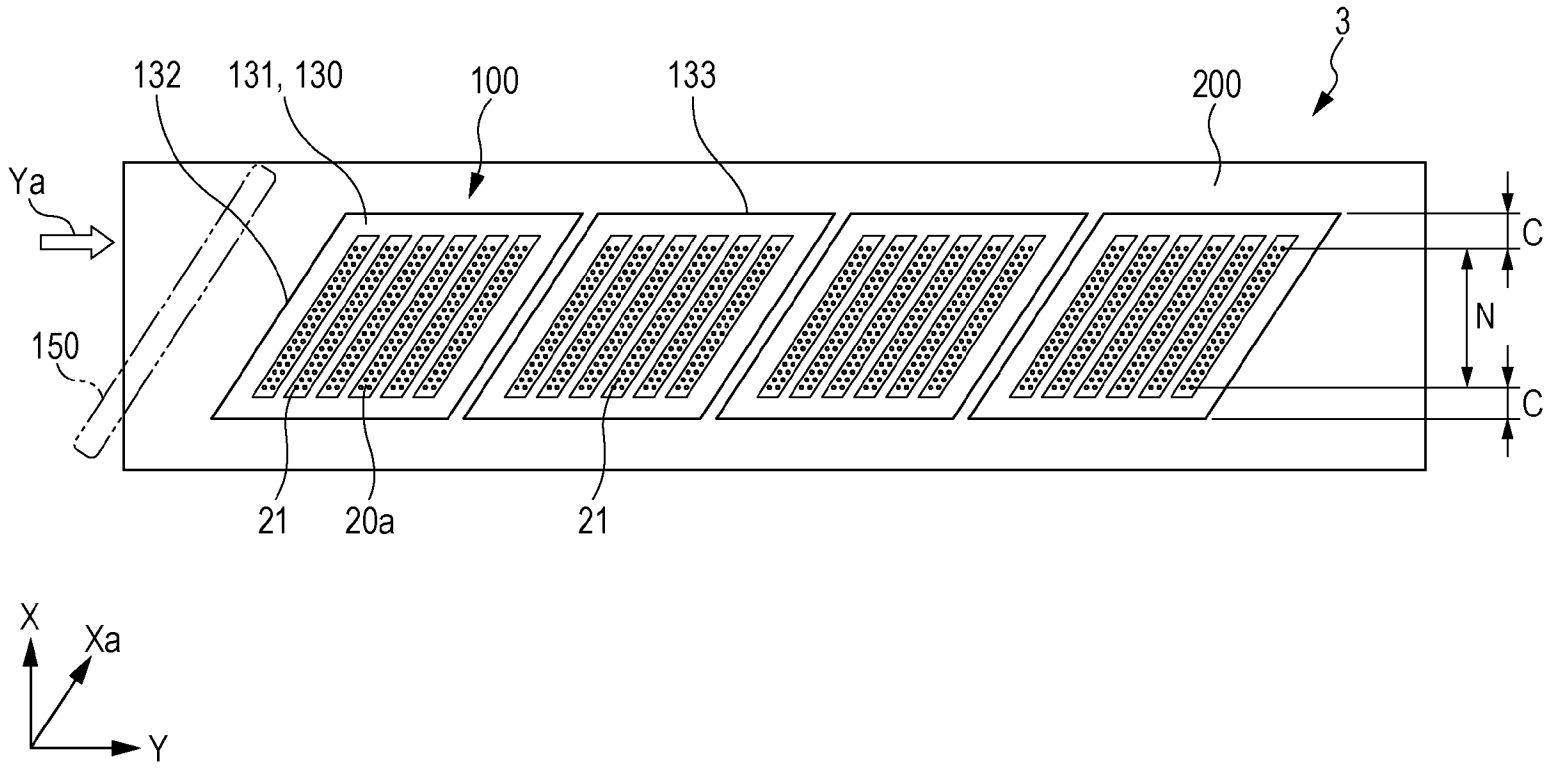
FIG. 7 is a plan view of the head unit from a liquid ejecting surface side according to Embodiment 1.

Hereinafter, the embodiment will be described in detail with reference to the drawings. FIG. 7 is a plan view of the liquid ejecting head unit from a liquid ejecting surface side according to the above-described Embodiment, and illustrates a relationship of the wiper which wipes the liquid ejecting surface. As illustrated in FIG. 7, a wiper blade 150 which is the wiper is disposed along the fourth direction Xa which is the direction in which the nozzle openings 21 of the ink jet type recording head 100 are provided in parallel, and a relative movement direction Ya with respect to the cover 130 of the wiper blade 150 matches the second direction Y. In this configuration, since the edge portion 133 of the cover 130 is on the outer side of a nozzle opening area N provided with the nozzle openings 21 in the first direction X, the above-described effect is achieved. In addition, it is preferable that a clearance C which is a distance between the end portion of the nozzle opening area N and the edge portion 133 in the first direction X be set to be longer than a meandering distance of the wiper blade 150 in the first direction X which is assumed at a time of wiping operation. In the ink jet type recording head unit in which the plurality of ink jet type recording heads 100 are provided in parallel in the second direction Y, it is easy for the wiper blade 150 to meander in the first direction X, and the part of the wiper which has a possibility of being damaged by the edge portion 133 when the wiper blade 150 meander also increases. However, by disposing the edge portion 133 on the side further outward than a distance in consideration of the meandering, not only at an initiating position but also at an ending position of the relative movement of the wiper, it is possible to reduce a possibility that the wiping of the group of nozzle openings 21 is performed by the part of the wiper which may be damaged by the edge portion 133.

Figure 8:
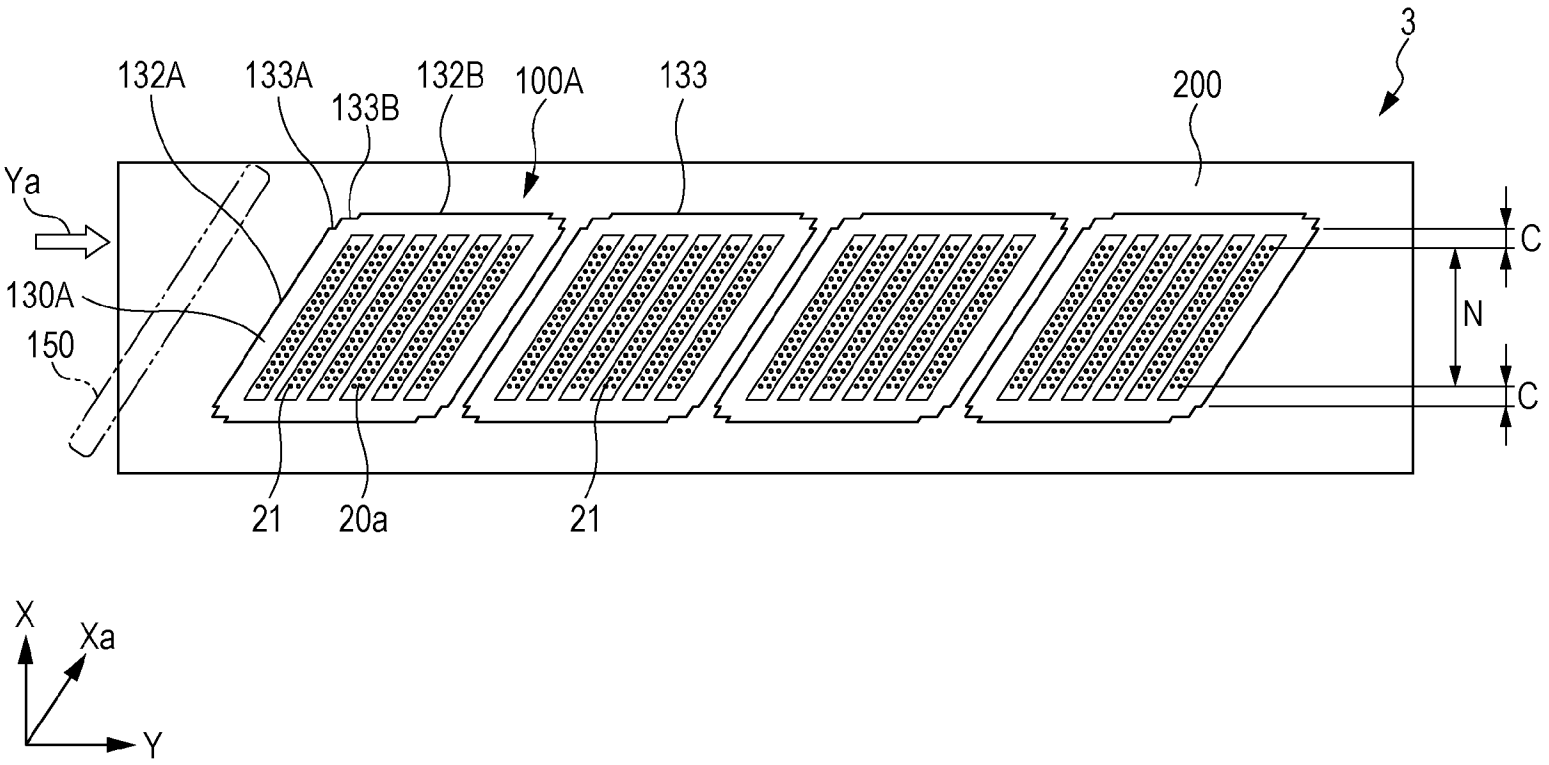
FIG. 8 is a plan view of a head unit from the liquid ejecting surface side according to the second example of Embodiment 1 of the invention.

FIG. 8 is a plan view from the liquid ejecting surface side of a case of the ink jet type recording head unit provided with a ink jet type recording head 100A having the cover 130A of a second example of the above-described embodiment with reference to FIG. 6. The wiper blade 150 which is the wiper is disposed along the fourth direction Xa which is the direction in which the nozzle openings 21 are provided in parallel, and the relative movement direction Ya with respect to the cover 130A of the wiper blade 150 matches the second direction Y. In this configuration, since the edge portions 133A and 133B of the cover 130A are on the outer side of a nozzle opening area N provided with the nozzle openings 21 in the first direction X, the above-described effect is achieved.

In addition, it is preferable that the clearance C which is the distance between the end portion of the nozzle opening area N and the edge portion 133A in the first direction X be set to be longer than the meandering distance of the wiper blade 150 in the first direction X which is assumed at a time of wiping operation. Accordingly, an effect similar to the above-described effect is achieved.

Figure 9:
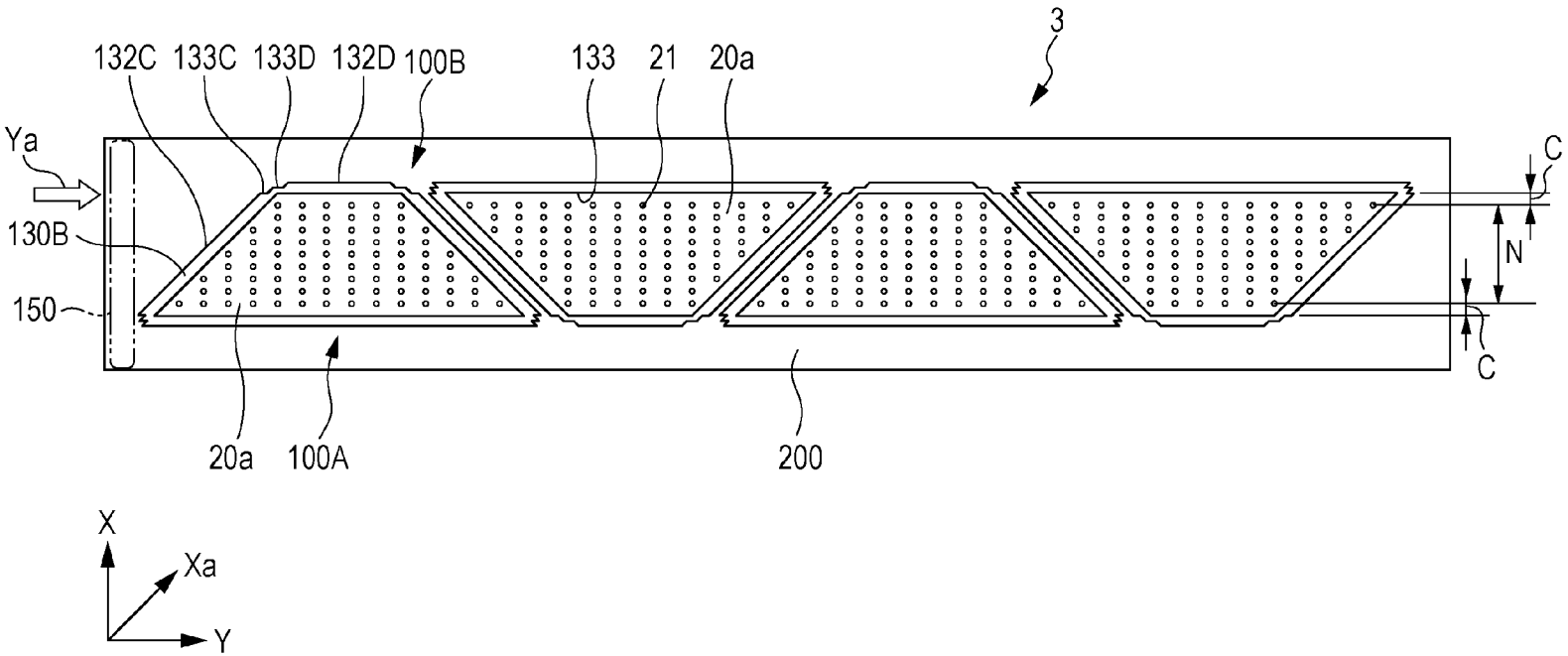
FIG. 9 is a plan view of the head unit from the liquid ejecting surface side according to a third example of Embodiment 1 of the invention.

FIG. 9 is a plan view from the liquid ejecting surface side of a case of an ink jet type recording head 100B provided with a cover 130B which has a trapezoidal external shape of the cover 130A in FIG. 6, as a third example of the embodiment.

As illustrated in FIG. 9, the cover 130B has a trapezoidal shape when viewed from the liquid ejecting surface 20*a* side in a planar view. In addition, the plurality of covers 130B is provided in parallel in the second direction Y and is fixed to the head fixing substrate 200. Every other cover 130B provided in parallel in the second direction Y is disposed to be rotated by 180 degrees in the in-plane directions of the liquid ejecting surface 20*a*. In the ink jet type recording head 100A, the nozzle openings 21 are disposed in a matrix form on the liquid ejecting surface 20*a*.

In this configuration, since the edge portions 133C and 133D of the cover 130B are on the outer side of the nozzle opening area N provided with the nozzle openings 21 in the first direction X, the above-described effect is achieved.

In addition, it is preferable that the clearance C which is the distance between the end portion of the nozzle opening area N and the edge portions 133C and 133D in the first direction X be set to be longer than the meandering distance of the wiper blade 150 in the first direction X which is assumed at a time of wiping operation. Accordingly, an effect similar to the above-described effect is achieved.

Figure 10:
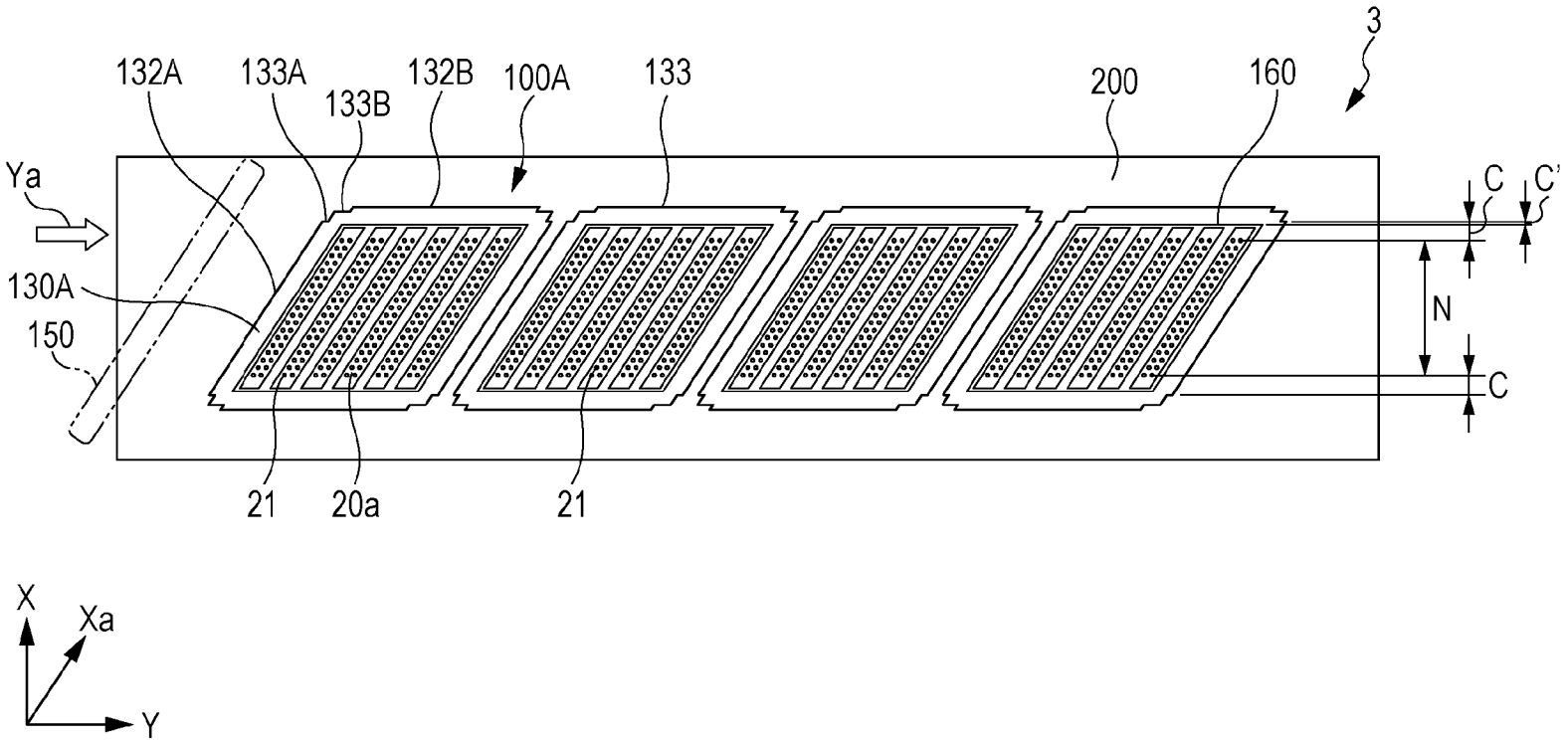
FIG. 10 is a plan view of the head unit from the liquid ejecting surface side according to the second example of Embodiment 1 of the invention.

In the example in FIGS. 7 to 9, the edge portions 133 and 133A to 133D of the covers 130, 130A, and 130B are disposed on the outer side of the nozzle opening area N, but more preferably, the edge portions 133 and 133A to 133D may be provided on the side further outward than an abutting area of a rib of a cap which caps the liquid ejecting surface 20*a*. For example, the abutting area of the rib of the cap is illustrated in FIG. 10 by taking an example of the cover 130A illustrated in FIG. 8. In this case, as illustrated in FIG. 10, an abutting area 160 of the cap exists on the side further outward than the nozzle opening area N, but the edge portions 133A and 133B exist on a side much further outward, and is a clearance C' of the abutting area 160 and the edge portions 133A and 133B.

The liquid tends to be likely to remain in the abutting area of the rib of the cap. However, when the edge portions 133 and 133A to 133D are disposed on the outer side of the abutting area, even if the wiping is performed by the wiper blade 150 which is damaged by the edge portions 133 and 133A to 133D, the wiping of the capping area is not influenced, and an effect that the wiping effect of the capping area does not decrease is achieved. In addition, even in this case, it is preferable as described above that the clearance C which is the distance between the end portion of the nozzle opening area N and the edge portions 133 and 133A to 133D in the first direction X be set to be longer than a meandering distance of the wiper blade 150 in the first direction X which is assumed at a time of wiping operation.

In the embodiment of FIG. 8, since the wiper blade 150 is disposed along the fourth direction Xa which is the direction in which the nozzle openings 21 are provided in parallel and the edge portion 133A is disposed along the fourth direction Xa, when the wiper blade 150 is in contact with the edge portion 133A, both ends of the wiper blade 150 are in contact with the edge portion 133A at the same time. For this reason, compared to a case where only one side is in contact with the edge portion 133A, an effect which can reduce a possibility that the wiper blade 150 is inclined is achieved.

In addition, even in any one of FIGS. 7 to 9, when the wiper blade 150 is disposed along the first direction X, a similar effect is achieved.

In the above-described embodiment, a case where the plurality of openings is provided in one cover is described as an example. However, even in the ink jet type recording head provided with one opening in one cover, needless to say, the above-described configuration may be employed, and the similar effect is achieved.

In addition, the ink jet type recording head unit having the plurality of ink jet type recording heads is described as an example, but even in a serial type liquid ejecting apparatus having one ink jet type recording head, the above-described configuration can be employed, and a similar effect can be achieved.

Hereinafter, an effect of the invention illustrating Embodiment 2 of the invention will be further described. In addition, a configuration of Embodiment 2 which is not particularly described is the configuration in common with Embodiment 1.

Embodiment 2

Figure 11:
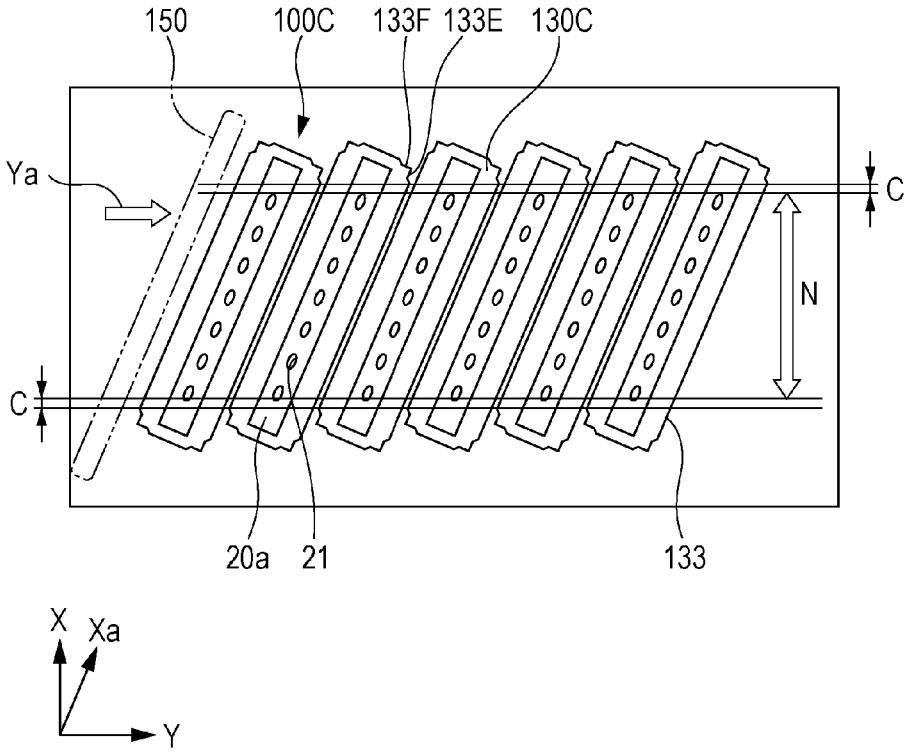
FIG. 11 is a plan view of a head unit from the liquid ejecting surface side according to Embodiment 2 of the invention.

FIG. 11 illustrates a plan view of the liquid ejecting head unit from the liquid ejecting surface side according to Embodiment 2. As described in FIG. 11, an ink jet type recording head 100C has a rectangular shape when viewed from the liquid ejecting surface 20*a* side in a planar view, and is provided with a rectangular cover 130C. In the example, the direction in which the nozzle openings 21 of the plurality of ink jet type recording heads 100C are provided in parallel is inclined to be along the fourth direction Xa and the plurality of ink jet type recording heads 100C is disposed in parallel in the second direction Y. At four corners of the cover 130C of each of the ink jet type recording heads 100C, the edge portions 133E and 133F are provided. In addition, the ink jet type recording head 100C is provided with one cover 130C and the number of rows of the nozzle openings 21 is one, but the plurality of covers 130C is provided. In addition, two or more rows of nozzle openings 21 may be exposed from each of the covers 130C.

In the example, The wiper blade 150 which is the wiper is disposed along the fourth direction Xa which is the direction in which the nozzle openings 21 of the ink jet type recording head 100C are provided in parallel, and the relative movement direction Ya with respect to the cover 130C of the wiper blade 150 matches the second direction Y. In this configuration, since the edge portions 133E and 133F of the cover 130 are on the outer side of a nozzle opening area N provided with the nozzle openings 21 in the first direction X, the above-described effect is achieved. In addition, it is preferable as described above that the clearance C which is the distance between the end portion of the nozzle opening area N and the edge portions 133E to 133F in the first direction X be set to be longer than the meandering distance of the wiper blade 150 in the first direction X which is assumed at a time of wiping operation.

In addition, in the embodiment of FIG. 11, since the wiper blade 150 is disposed along the fourth direction Xa which is the direction in which the nozzle openings 21 are provided in parallel and the edge portion 133E is disposed along the fourth direction Xa, when the wiper blade 150 is in contact with the edge portion 133E, both ends of the wiper blade 150 are in contact with the edge portion 133E at the same time. For this reason, compared to a case where only one side is in contact, an effect which can reduce a possibility that the wiper blade 150 is inclined is achieved.

Furthermore, the edge portions 133E to 133F of the cover 130C are disposed on the outer side of the nozzle opening area N, but more preferably, similarly, the edge portions 133E to 133F may be provided on the side further outward than the abutting area of the rib of the cap which caps the liquid ejecting surface 20*a*. According to this, the liquid tends to be likely to remain in the abutting area of the rib of the cap. However, when the edge portions 133E to 133F are disposed on the outer side of the abutting area, even if the wiping is performed by the wiper blade 150 which is damaged by the edge portions 133E to 133F, the wiping of the capping area is not influenced, and an effect that the wiping effect of the capping area does not decrease is achieved. In addition, even in this case, it is preferable as described above that the clearance C which is the distance between the end portion of the nozzle opening area N and the edge portions 133E to 133F in the first direction X be set to be longer than a meandering distance of the wiper blade 150 in the first direction X which is assumed at a time of wiping operation.

In addition, even in the example of FIG. 11, even when the wiper blade 150 is disposed along the first direction X, a similar effect is achieved.

Hereinafter, a comparative example in a case where the plurality of ink jet type recording heads 100C is disposed and a line head is formed similarly to in FIG. 11 will be described.

Figure 12:
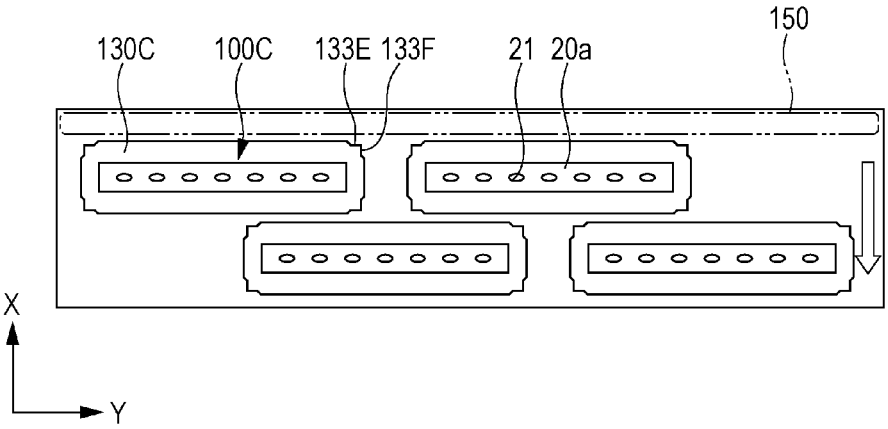
FIG. 12 is a plan view of a head unit from the liquid ejecting surface side of Comparative Example 1.

In Comparative Example 1 illustrated in FIG. 12, the plurality of ink jet type recording heads 100C is disposed in zigzags. In the example, the wiping is performed by one wiper blade 150 by considering the relative movement direction as the direction which intersects with the rows of the nozzle openings 21.

In this case, since the wiper blade 150 relatively moves in a direction that intersects with the rows of the nozzle openings 21, the wiping property is excellent. However, since the edge portions 133E and 133F of the cover 130C are overlapped in the part of the wiper which performs the wiping of the rows of the nozzle openings 21, there is a disadvantage that the durability of the wiper blade 150 decreases and the wiping defect is likely to occur. In addition, there is a problem in that the size of the wiper is large.

Figure 13:
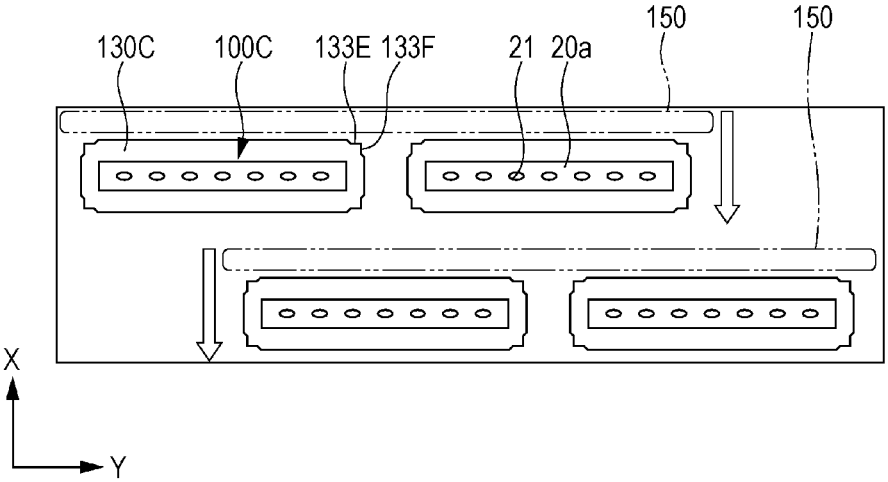
FIG. 13 is a plan view of a head unit from the liquid ejecting surface side of Comparative Example 2.

Comparative Example 2 illustrated in FIG. 13 is similar to Comparative Example 1 in that the plurality of ink jet type recording heads 100C is disposed in zigzags. However, the wiping is performed in the relative movement direction which intersects with the rows of the nozzle openings 21 by using the plurality of wiper blades 150.

In this case, since the wiper blade 150 relatively moves in a direction that intersects with the rows of the nozzle openings 21, the wiping property is excellent. In addition, since the edge portions 133E and 133F of the cover 130C are not overlapped in the part of the wiper which performs the wiping of the rows of the nozzle openings 21, the durability of the wiper blade is not poor. However, there is a disadvantage that the size of the wiper blade 150 is large and the size of the apparatus extends as much as the number of the wipers increases.

Figure 14:
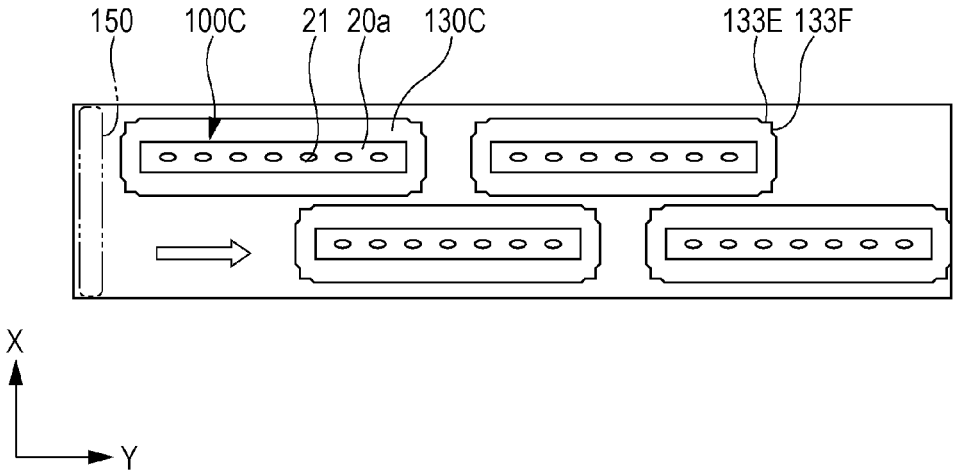
FIG. 14 is a plan view of a head unit from the liquid ejecting surface side of Comparative Example 3.

Comparative Example 3 illustrated in FIG. 14 is similar to Comparative Example 1 in that the plurality of ink jet type recording heads 100C is disposed in zigzags. However, the relative movement direction of the wiper blade 150 is the direction of the rows of the nozzle openings 21.

In this case, since the edge portions 133E and 133F of the cover 130C are not overlapped in the part of the wiper which performs the wiping of the rows of the nozzle openings 21, the durability of the wiper blade 150 is not poor. However, there is a disadvantage that the wiping property when the wiper blade 150 relatively moves in a direction along the rows of the nozzle openings 21 is not excellent. In addition, the opening of the cover 130 for exposing the nozzle blade provided with the nozzle openings 21 is rectangular. However, in order to bring the tip end of the wiper blade 150 sufficiently into contact with the nozzle blade, there is a disadvantage that the width to an extent of having the opening is required. In other words, in a case of relative moving to the direction along the rows of the nozzle openings 21, the width direction of the wiper blade 150 is a short-side side of the opening. For this reason, there is a disadvantage that the tip end of the wiper blade 150 is not sufficiently in contact with the nozzle blade, and in particular, the tendency deteriorates as much as the length of the line head becomes longer in a length direction.

In this manner, even in Comparative Examples 1 to 3, it is apparent that the configuration in FIG. 11 is excellent.

Embodiment 3

Figure 15:
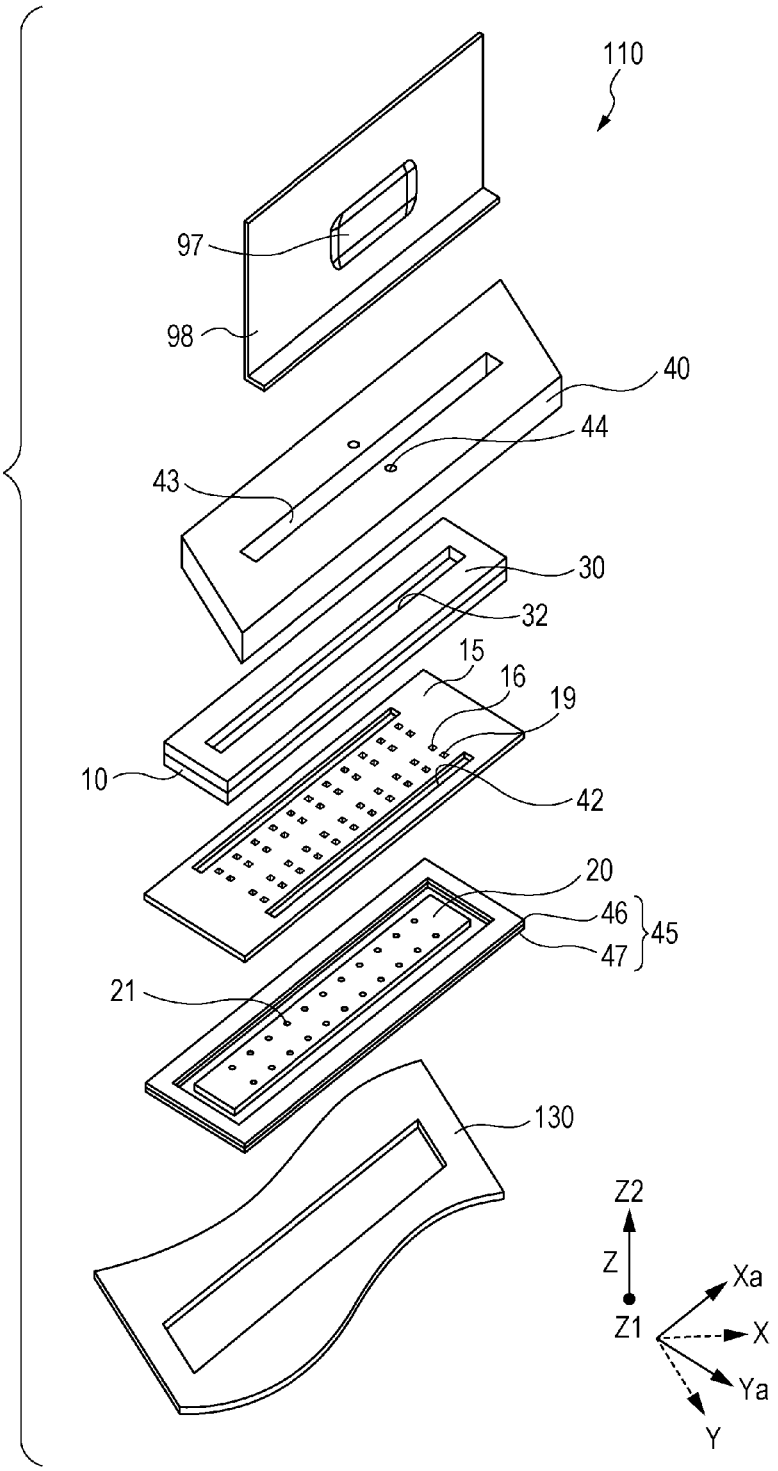
FIG. 15 is an exploded perspective view of a head main body according to Embodiment 1 of the invention.
Figure 16:
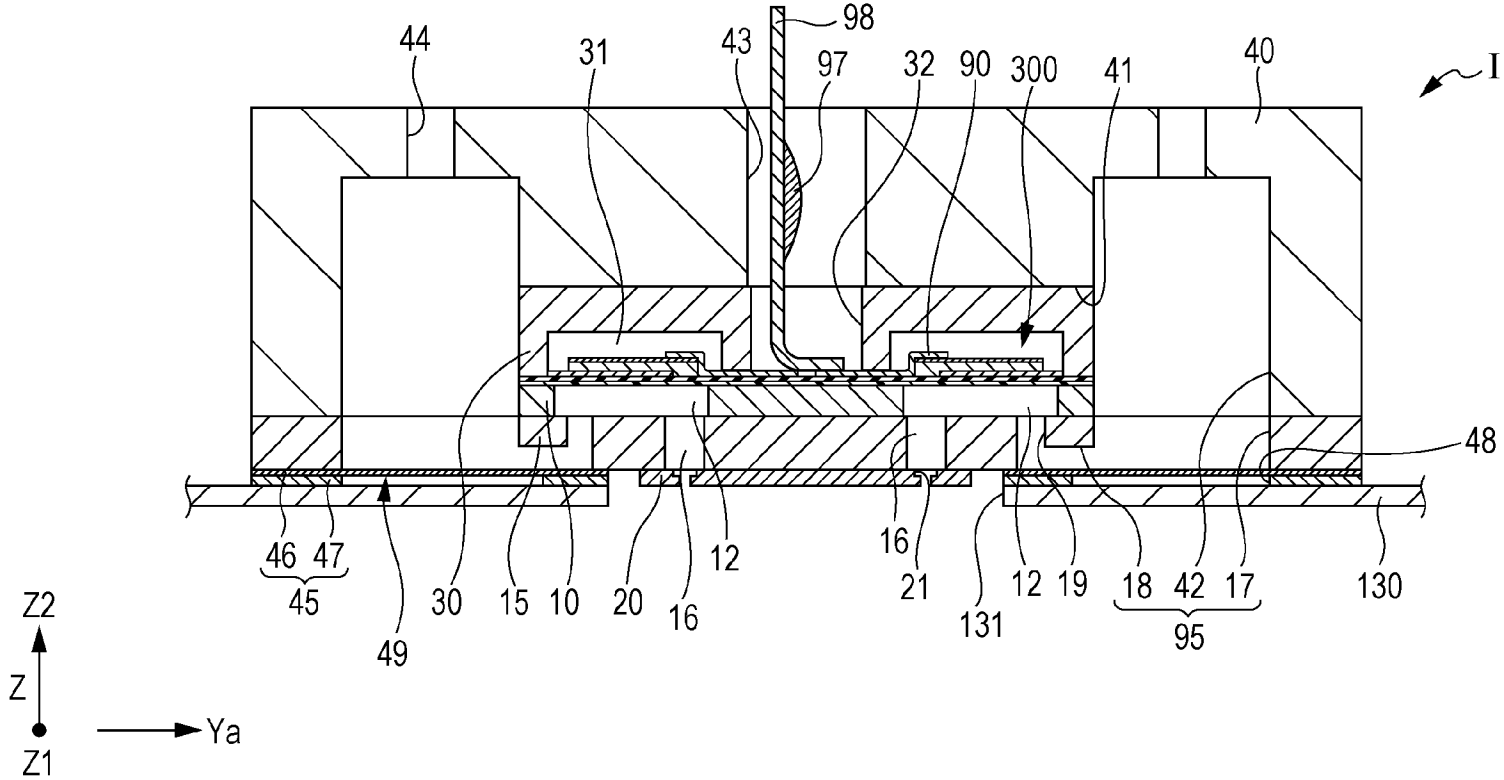
FIG. 16 is a cross-sectional view of the head main body according to Embodiment 1 of the invention.

Hereinafter, an example of the head main body 110 the ink jet type recording head 100 of the above-described liquid ejecting apparatus in Embodiments 1 and 2 will be described in detail, but the configuration of the head main body 110 is not limited to the configuration below. In addition, FIG. 15 is a perspective view of the head main body according to Embodiment 1 of the invention. FIG. 16 is a cross-sectional view of the head main body in the second direction Y.

As illustrated in the drawings, the head main body 110 of the embodiment has the plurality of members, such as a flow path forming substrate 10, a communication board 15, a nozzle plate 20, a protection substrate 30, a compliance substrate 45, or a case 40, and the plurality of members are bonded by the adhesive or the like.

As illustrated in the drawings, by performing anisotropic etching from one surface side, on the flow path forming substrate 10 which constitutes the head main body 110, a pressure generation chamber 12 defined by a plurality of partitions is provided in parallel along the direction in which the plurality of nozzle openings 21 is provided in parallel. In addition, in the embodiment, the direction in which the pressure generation chambers 12 are provided in parallel matches the fourth direction Xa, and on the flow path forming substrate 10, a plurality of rows, in the embodiment, two rows in which the pressure generation chambers 12 are provided in parallel in the fourth direction Xa, are provided. Hereinafter, the direction, in which the plurality of pressure generation chambers 12 rows formed by the pressure generation chambers 12 provided in the fourth direction Xa is provided, will be called a fifth direction Ya. In addition, in the embodiment, the direction perpendicular to the fourth direction Xa and the fifth direction Ya matches the third direction Z. In addition, the head main bodies 110 of the embodiment are mounted on the head unit 3 so that the fourth direction Xa in which the nozzle openings 21 are provided in parallel is a direction which is inclined with respect to the first direction X that is the transporting direction of the recording sheet S.

In addition, on the flow path forming substrate 10, at one end portion side of the pressure generation chamber 12 in the fifth direction Ya, the opening area may be smaller than the pressure generation chamber 12, and a supply path which imparts a flow path resistance of the ink which flows into the pressure generation chamber 12 or the like may be provided.

In addition, as illustrated in FIG. 15, the communication board 15 is bonded to one surface side of the flow path forming substrate 10. In addition, the nozzle plate 20, in which the plurality of nozzle openings 21 that communicates with each of the pressure generation chambers 12 is provided, is bonded to the communication board 15. In the embodiment, the Z1 side, which is one surface of the third direction Z in which the nozzle openings 21 of the nozzle plate 20 are opened, is the liquid ejecting surface 20*a*.

On the communication board 15, a nozzle communication path 16, which communicates with the pressure generation chambers 12 and the nozzle openings 21, is provided. The communication board 15 has an area greater than that of the flow path forming substrate 10, and the nozzle plate 20 has an area less than that of the flow path forming substrate 10. In this manner, by making the area of the nozzle plate 20 relatively small, it is possible to reduce the cost.

In addition, on the communication board 15, a first manifold portion 17 and a second manifold portion 18 which constitute a part of a manifold 95 are provided.

The first manifold portion 17 is provided to penetrate the communication board 15 in the third direction Z.

In addition, the second manifold portion 18 does not penetrate the communication board 15 in the third direction Z, and is provided in the middle of the third direction Z to be opened to the nozzle plate 20 side of the communication board 15.

Furthermore, on the communication board 15, a supply communication path 19, which communicates with one end portion of the pressure generation chamber 12 in the second direction Y, is independently provided for every pressure generation chamber 12. The supply communication path 19 communicates with the second manifold portion 18 and the pressure generation chamber 12.

On the nozzle plate 20, the nozzle openings 21 which communicate with each of the pressure generation chambers 12 via the nozzle communication path 16 are formed. In other words, in the nozzle openings 21, openings which eject the ink that is the same type of liquid are provided in parallel in the fourth direction Xa, and two rows in which the nozzle openings 21 are provided in parallel in the fourth direction Xa are formed in the fifth direction Ya.

Meanwhile, at a surface side opposite to the communication board 15 of the flow path forming substrate 10, a diaphragm is formed. In addition, on the diaphragm, by sequentially stacking a first electrode, a piezoelectric layer, and a second electrode, a piezoelectric actuator 300 which is a pressure generation section of the embodiment is configured. In general, any one electrode of the piezoelectric actuator 300 is a common electrode, and the other electrode and the piezoelectric layer are patterned for every pressure generation chamber 12.

In addition, the protection substrate 30 which has substantially the same size as the flow path forming substrate 10 is bonded to a surface of the piezoelectric actuator 300 side of the flow path forming substrate 10. The protection substrate 30 has a maintaining portion 31 which is a space for protecting the piezoelectric actuator 300. In addition, a through-hole 32 which penetrates in the third direction Z is provided on the protection substrate 30. An end portion of a lead electrode 90 derived from the electrode of the piezoelectric actuator 300 extends to be exposed to the inside of the through-hole 32, and the lead electrode and a wiring substrate 98 which has a driving circuit 97, such as a driving IC, mounted thereon are electrically connected to each other inside the through-hole 32.

In addition, the case 40, which defines the manifold 95 that communicates with the plurality of pressure generation chambers 12, is fixed to the protection substrate 30 and the communication board 15. The case 40 which has a shape which is substantially the same as the communication board 15 described above in a planar view, is bonded to the protection substrate 30, and is bonded even to the communication board 15 described above. In particular, the case 40 has a concave portion 41 which has a depth to accommodate the flow path forming substrate 10 at the protection substrate 30 side and the protection substrate 30. The concave portion 41 has an opening area which is wider than a surface which is bonded to the flow path forming substrate 10 of the protection substrate 30. An opening surface of the nozzle plate 20 side of the concave portion 41 in a state where the flow path forming substrate 10 or the like is accommodated in the concave portion 41, is sealed by the communication board 15. Accordingly, in the outer circumferential portion of the flow path forming substrate 10, a third manifold portion 42 is defined by the case 40, the flow path forming substrate 10, and the protection substrate 30. The manifold 95 of the embodiment is configured by the third manifold portion 42, and by the first manifold portion 17 and the second manifold portion 18 which are provided on the communication board 15.

In addition, the compliance substrate 45 is provided on a surface on which the first manifold portion 17 and the second manifold portion 18 of the communication board 15 are opened. The compliance substrate 45 seals the opening of the first manifold portion 17 and the second manifold portion 18.

In the embodiment, the compliance substrate 45 has a sealing film 46 and a fixed substrate 47. The sealing film 46 is formed of a thin film having flexibility (for example, polyphenylene sulfide (PPS) or stainless steel (SUS)). In addition, the fixed substrate 47 is formed of a hard material, such as a metal including stainless steel (SUS). Since an area of the fixed substrate 47 facing the manifold 95 is made of an opening portion 48 which is completely removed in a thickness direction, one surface of the manifold 95 is a compliance portion 49 which is a flexible portion sealed only by the sealing film 46 having flexibility.

In addition, in the embodiment, the cover 130 which is a fixing board is adhered to a surface side opposite to the communication board 15 of the compliance substrate 45. In other words, the exposure opening portion 134 provided in the base portion 131 of the cover 130 has the opening area which is wider than the area of the nozzle plate 20, and exposes the liquid ejecting surface 20*a* of the nozzle plate 20 inside the exposure opening portion 134. The cover 130 is not limited thereto, and for example, the exposure opening portion 134 of the cover 130 may be the opening area which is smaller than an external shape of the nozzle plate 20, and the cover 130 may abut against or be adhered to the liquid ejecting surface 20*a* of the nozzle plate 20. Even when the exposure opening portion 134 of the cover 130 is the opening area which is smaller than the external shape of the nozzle plate 20, the cover 130 and the liquid ejecting surface 20*a* may be provided to be in contact with each other. In other words, a case where the cover 130 is provided on the liquid ejecting surface 20*a* side includes a case where the liquid ejecting surface 20*a* is not in contact or a case where the liquid ejecting surface 20*a* is in contact.

In addition, in the embodiment, the cover 130 is adhered to the fixed substrate 47 of the compliance substrate 45. Accordingly, it is possible to seal the maintaining portion 121 between the cover 130 and the holder 120 as described above, and to suppress evaporation of the moisture of the ink.

In addition, in the case 40, an introducing path 44 for supplying the ink to each of the manifolds 95 by communicating with the manifold 95 is provided. In addition, in the case 40, a connection port 43, which communicates with the through-hole 32 of the protection substrate 30 and in which the wiring substrate 98 is inserted, is provided.

In the head main body 110 having the configuration, when the ink is ejected, the ink is incorporated via the introducing path 44 from a storage section, and the inside of the flow path from the manifold 95 to the nozzle opening 21 is filled with the ink. After that, according to a signal from the driving circuit 97, by applying a voltage to each piezoelectric actuator 300 corresponding to the pressure generation chamber 12, the diaphragm together with the piezoelectric actuator 300 is flexurally deformed. Accordingly, the pressure inside the pressure generation chamber 12 increases, and the ink droplets are ejected from predetermined nozzle openings 21.

Another Embodiment

Above, an embodiment of the invention is described, but a basic configuration of the invention is not limited to the above description.

For example, in the above-described Embodiments 1 to 3, the head main body 110 includes the plurality of members, such as the flow path forming substrate 10, the communication board 15, the nozzle plate 20, the protection substrate 30, the compliance substrate 45, or the case 40. However, in order to eject the liquid from the nozzle openings 21 provided on the liquid ejecting surface 20*a*, at least a stress generation section which communicates with the nozzle openings 21 and generates the stress to the pressure generation chamber 12, and the plurality of pressure generation chambers 12 provided with the pressure generation section and provided in parallel along a predetermined direction, may be included. In other words, in the above-described Embodiment 1, the Z1 side of the holder 120 is adhered to the Z2 side of the head main body 110, and the head main body stacks the case 40 at the side closest to Z2. However, the head main body 110 is not required to be adhered to the holder 120 via the case 40, and may be adhered to the holder 120 without using the case 40.

In addition, in the above-described Embodiments 1 to 3, the cover 130 which is the fixing board provided on the liquid ejecting surface 20*a* side of the ink jet type recording head 100 and the nozzle plate 20 provided with the nozzle openings 21 of the head main body 110 are separated, but the invention is not limited thereto. The nozzle plate 20 may extend to the outer side of the head main body 110, and the bending portion 132 may be provided by folding the extended end portion in the Z2 direction. In other words, in this case, the nozzle plate 20 corresponds to the fixing board, and the nozzle plate 20 is adhered to the head main body 110. In other words, a case where the fixing board is provided on the liquid ejecting surface 20*a* side with respect to the head main body 110 includes a case where one surface of the fixing board is the liquid ejecting surface 20*a*. In addition, since the fixing board may be provided on the liquid ejecting surface 20*a* side with respect to the head main body 110, the fixing board may not be provided to be protruded to the most liquid ejecting surface 20*a* side. In other words, in the above-described Embodiments 1 to 3, the liquid ejecting surface 20*a* of the nozzle plate 20 may be provided to be protruded to the Z1 side rather than to the cover 130. Furthermore, another member which is different from the nozzle plate 20 may be provided on the Z1 side rather than the fixing board on the liquid ejecting surface 20*a* side of the ink jet type recording head 100. In addition, when the fixing board is provided at a side opposite to the holder 120 with respect to the head main body 110, the fixing board is provided on the liquid ejecting surface 20*a* side with respect to the head main body 110.

In addition, in the above-described Embodiments 1 to 3, the direction, in which the plurality of ink jet type recording heads 100 maintained in the head fixing substrate 200 is provided in parallel, is the second direction Y which is the direction perpendicular to the first direction X that is the transporting direction of the recording sheet S, but the invention is not limited thereto. The head unit, in which the ink jet type recording heads 100 are provided in parallel in a longitudinal direction of the head fixing substrate 200, may be disposed to be at an angle in which an alignment direction of the plurality of ink jet type recording heads 100 intersects with the first direction X which is the transporting direction of the recording sheet S, that is, an angle which is less than 90 degrees with respect to the first direction X. At that time, in the in-plane directions of the liquid ejecting surface 20*a*, even when the nozzle rows are provided in a direction perpendicular to the longitudinal direction of the head fixing substrate 200, by inclining the entire head unit, it is possible to dispose the nozzle rows inclined with respect to the first direction X which is the transporting direction.

Furthermore, in the above-described Embodiments 1 to 3, the fourth direction Xa which is the direction in which the nozzle openings 21 of the head main body 110 are provided in parallel is disposed to be a direction which is inclined with respect to the second direction Y perpendicular to the first direction X which is the transporting direction. However, the fourth direction Xa in which the nozzle openings 21 are provided in parallel may be the same direction as the first direction X which is the transporting direction, and the fourth direction Xa in which the nozzle openings 21 are provided in parallel may be the same direction as the second direction Y. Furthermore, the nozzle openings 21 are not limited to the openings provided in a row form, and the nozzle openings 21 may be disposed in the matrix form. Furthermore, in the above-described Embodiment 1, when viewed in a planar view from the third direction Z perpendicular to the liquid ejecting surface 20*a*, the shape of the holder 120 is a substantial parallelogram, but the shape is not limited thereto, and may be rectangular, trapezoidal, or polygonal.

Even in this configuration, similarly to in the above-described Embodiments 1 to 3, by disposing the edge portions 133 and 133A to 133F of the cover 130 on the outer side of the nozzle opening area N in which the nozzle openings 21 exist in the second direction Y, it is possible to improve the durability of the wiper without generating the wiper defect.

Furthermore, in the above-described Embodiments 1 to 3, the concave portion 123 is provided in the holder 120, and the bending portion 132 is inserted into the concave portion 123 and adhered via the adhesive 141. However, the invention is not particularly limited thereto, and the concave portion 123 may not be provided. In other words, the bending portion 132 may be adhered to the side surface of the holder 120.

In addition, in the above-described Embodiments 1 to 3, the leg portions 122 are not provided at both sides of the holder 120 in the second direction Y, but the invention is not particularly limited thereto. For example, in the ink jet type recording heads 100 provided in parallel, the ink jet type recording heads 100 at both end portions of the second direction Y which is the parallel direction may be provided with leg portion 122 at a side where the adjacent ink jet type recording head 100 does not exist without providing the leg portion 122 at a side where the adjacent ink jet type recording heads 100 exist in the second direction Y.

Furthermore, in the above-described Embodiments 1 to 3, the so-called line type recording apparatus is described as an example of the ink jet type recording apparatus 1 in which the head unit 3 is fixed to the apparatus main body 2 and the printing is performed only by transporting the recording sheet S, but the invention is not particularly limited thereto. It is possible to employ the invention even in a so-called serial type recording apparatus in which the head unit 3 is mounted on a carriage which moves in the direction which intersects with the first direction X that is the transporting direction of the recording sheet S, for example, the second direction Y and the printing is performed while the head unit 3 moves in the direction which intersects with the transporting direction. In addition, the configuration is not limited to the configuration in which the recording sheet S is transported with respect to the head unit 3. The printing may be performed by a configuration in which the head unit 3 is transported with respect to the recording sheet S, and the recording sheet S may be relatively transported with respect to the head unit 3.

In addition, in the above-described Embodiments 1 to 3, the pressure generation section which causes a pressure change in the pressure generation chamber 12 is described by using the piezoelectric actuator 300 stacked in the third direction Z. However, the piezoelectric actuator 300, for example, may be a thin film type formed by a film forming method or a lithography method, a thick film type formed by a method such as sticking a green sheet, or the like. In addition, the piezoelectric actuator 300 can be alternately stacked with a piezoelectric material and an electrode forming material, and can use a longitudinal vibration type which extends and contracts in an axial direction. In addition, as the pressure generation section, it is possible to use a section which disposes a heating element inside the pressure generation chamber and ejects the liquid droplets from the nozzle openings 21 by bubbles generated by heating the heating element, a so-called an electrostatic actuator which generates static electricity between the diaphragm and the electrode and ejects the liquid droplets from the nozzle openings 21 by deforming the diaphragm according to a electrostatic force, or the like.

In addition, in the above-described Embodiments 1 to 3, the transporting direction of the recording sheet S is referred to as the first direction X, the direction perpendicular to the first direction X in the in-plane directions in which the nozzle openings of the head unit 3 is opened is referred to as the second direction Y, and the direction perpendicular to the first direction X and the second direction Y is referred to as the third direction Z. The fourth direction Xa which is the direction in which the nozzle openings 21 are provided in parallel is inclined with respect to the first direction X, and the fifth direction Ya which is a relative movement direction of a wiper blade 150 with respect to the cover 130 matches the second direction Y, but the invention is not limited thereto. For example, with respect to the fifth direction Ya which is the relative movement direction of a wiper blade 150 with respect to the cover 130, the fourth direction Xa in which the nozzle openings 21 are provided in parallel is inclined, and the direction perpendicular to the fourth direction Xa and the fifth direction Ya may be referred to as the third direction Z. In the in-plane directions in which the nozzle openings of the head unit 3 are opened, the direction which intersects with the fourth direction Xa and the fifth direction Ya may be referred to as the first direction X which is the transporting direction of the recording sheet S. The second direction Y may match the fifth direction Ya, and the direction perpendicular to the fifth direction Ya in the in-plane directions in which the nozzle openings of the head unit 3 are opened may not match the first direction X. Even the liquid ejecting apparatus and the liquid ejecting head unit can employ the invention. In other words, in a part in which a group of nozzle openings in the wiper is wiped, a wiping defect does not occur and durability of the wiper is excellent since there is no interference with the edge portion of any of the fixing boards.

What is claimed is:

1. A liquid ejecting apparatus comprising:

liquid ejecting heads each configured to eject liquid from nozzle openings of a liquid ejecting surface provided with a group of nozzle openings;

fixing boards disposed along a second direction and each of which is provided on the liquid ejecting head at the liquid ejecting surface thereof; and a wiper configured to relatively move in the second direction, wherein each of the fixing boards includes:

a bending portion in which an outer circumferential side part viewed from the liquid ejecting surface side is bent to the liquid ejecting head side; and an edge portion in which the outer circumferential side part is not bent, wherein the edge portions of the fixing boards are disposed on a side further outward than the group of nozzle openings in a first direction perpendicular to the second direction, wherein the bending portion is disposed on the sides of the fixing board in the second direction and wherein the wiper is configured to wipe the fixing boards at the liquid ejecting surface side by relatively moving in the second direction.

2. The liquid ejecting apparatus according to claim 1, wherein a cap is configured to perform capping by being abutted against the fixing board is provided, and wherein the edge portions of the fixing boards are disposed on the side further outward than a capping area of the cap with respect to the fixing board in the first direction.

3. The liquid ejecting apparatus according to claim 1, wherein the bending portion is adhered to a side surface of a stacking member which is stacked on the liquid ejecting head side rather than on the fixing board.

4. The liquid ejecting apparatus according to claim 1, wherein the edge portions of the fixing boards are separated from the nozzle openings in the first direction by equal to or greater than a distance in consideration of meandering of the wiper.

5. The liquid ejecting apparatus according to claim 1, wherein the group of nozzle openings is provided along an inclination direction which is an inclined first direction, wherein the wiper is disposed along the inclination direction, and wherein the edge portion is disposed along the inclination direction.

6. The liquid ejecting apparatus according to claim 1, wherein a plurality of openings is provided on each of the fixing boards and the group of nozzle openings is exposed from each of the openings.

7. The liquid ejecting apparatus according to claim 1, further comprising:

a maintaining member having leg portions at each of both sides of the first direction, wherein the fixing board is fixed to the maintaining member by the leg portions.

8. The liquid ejecting apparatus according to claim 7, wherein the fixing board has the bending portions at each of both sides of the second direction, and wherein the fixing board is fixed to the side surface of the maintaining member by the bending portions.

9. The liquid ejecting apparatus according to claim 8, wherein the maintaining member has concave portions at each of the side surfaces of the first direction, and wherein the fixing board is adhered to the concave portion of the side surface of the maintaining member by the bending portion.

10. A liquid ejecting head unit, comprising:

liquid ejecting heads each configured to eject liquid from nozzle openings of a liquid ejecting surface provided with the group of nozzle openings; and fixing boards disposed along a second direction and each of which is provided on the liquid ejecting head at the liquid ejecting surface side thereof, wherein each of the fixing boards includes: a bending portion in which a side part is bent to a side opposite to the liquid ejecting surface; and an edge portion in which the side part is not bent, at an outer circumference viewed from the liquid ejecting surface side, and wherein the bending portions are disposed in the second direction such that the bending portion of adjacent fixing boards are adjacent to each other, and wherein the edge portions of the fixing boards are disposed on a side further outward than the groups of nozzle openings of the liquid ejecting heads in a first direction perpendicular to the second direction on the liquid ejecting surface.

11. The liquid ejecting apparatus according to claim 1, wherein the wiper is configured to wipe the nozzle openings with a part thereof that is configured to contact the bending portions and not to contact the edge portions of the fixing boards.

12. The liquid ejecting head unit according to claim 10, wherein the wiper is configured to wipe the nozzle openings with a part thereof that is configured to contact the bending portions and not to contact the edge portions of the fixing boards.

13. The liquid ejecting apparatus according to claim 1, wherein each of the liquid ejecting heads comprises a plurality of head main bodies.

14. The liquid ejecting head unit according to claim 10, wherein each of the liquid ejecting heads comprises a plurality of head main bodies.

* * * * *